US009427090B2

(12) United States Patent
Mossbeck et al.

(10) Patent No.: US 9,427,090 B2
(45) Date of Patent: Aug. 30, 2016

(54) POCKETED SPRING ASSEMBLY COMPRISING STRINGS OF SPRINGS HAVING Y-SHAPED SEAMS

(71) Applicant: L&P Property Management Company, South Gate, CA (US)

(72) Inventors: Niels S. Mossbeck, Carthage, MO (US); Darrell A. Richmond, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 176 days.

(21) Appl. No.: 14/246,245

(22) Filed: Apr. 7, 2014

(65) Prior Publication Data

US 2014/0373281 A1 Dec. 25, 2014

Related U.S. Application Data

(63) Continuation-in-part of application No. 14/242,077, filed on Apr. 1, 2014, which is a continuation-in-part of application No. 13/921,499, filed on Jun. 19, 2013, now Pat. No. 9,345,334.

(51) Int. Cl.

| | |
|---|---|
| ***A47C 23/04*** | (2006.01) |
| ***A47C 27/06*** | (2006.01) |
| ***A47C 27/05*** | (2006.01) |
| *A47C 27/00* | (2006.01) |
| *A47C 23/05* | (2006.01) |
| *A47C 27/07* | (2006.01) |

(52) U.S. Cl.

CPC ..... *A47C 27/064* (2013.01); *A47C 27/05* (2013.01); *A47C 27/053* (2013.01); *A47C 23/04* (2013.01); *A47C 23/05* (2013.01); *A47C 27/002* (2013.01); *A47C 27/06* (2013.01); *A47C 27/063* (2013.01); *A47C 27/07* (2013.01)

(58) Field of Classification Search

CPC .. A47C 27/064; A47C 27/06; A47C 27/063; A47C 27/07; A47C 27/002; A47C 23/04; A47C 23/05; A47C 23/30; A47C 27/05; A47C 27/053

See application file for complete search history.

(56) References Cited

U.S. PATENT DOCUMENTS

| | | | | | |
|---|---|---|---|---|---|
| 4,234,984 | A * | 11/1980 | Stumpf | A47C 27/064 | 5/655.8 |
| 4,451,946 | A * | 6/1984 | Stumpf | A47C 27/064 | 5/655.8 |
| 4,578,834 | A * | 4/1986 | Stumpf | A47C 27/064 | 156/291 |
| 5,016,305 | A * | 5/1991 | Suenens | A47C 27/064 | 5/655.8 |
| 5,048,167 | A * | 9/1991 | Heffley | A47C 27/063 | 29/402.03 |

(Continued)

FOREIGN PATENT DOCUMENTS

| | | |
|---|---|---|
| WO | 2013060983 | 5/2013 |

*Primary Examiner* — David E Sosnowski
*Assistant Examiner* — Morgan McClure
(74) *Attorney, Agent, or Firm* — Wood, Herron & Evans, LLP

(57) ABSTRACT

A bedding or seating product comprises a pocketed spring assembly comprising a plurality of parallel strings of individually pocketed springs. The product may have individual inserts between adjacent strings of springs. Adjacent individually pocketed springs are separated from each other by at least one separating seam. Each of the separating seams comprises a pair of Y-shaped or U-shaped seams which may be joined together or spaced apart.

25 Claims, 25 Drawing Sheets

(56) References Cited

U.S. PATENT DOCUMENTS 5,319,815 A * 6/1994 Stumpf ..... A47C 27/064 5/720
5,553,443 A * 9/1996 St. Clair ..... B68G 9/00 53/438
5,868,383 A * 2/1999 Codos ..... B68G 9/00 267/166.1
6,131,892 A * 10/2000 Stumpf ..... A47C 27/063 267/89
6,159,319 A * 12/2000 Mossbeck ..... A47C 27/064 156/182
6,272,706 B1 * 8/2001 McCune ..... A47C 27/064 267/91
6,336,305 B1 * 1/2002 Graf ..... B68G 9/00 53/114
6,397,418 B1 * 6/2002 Stjerna ..... A47C 27/062 5/655.8
6,398,199 B1 * 6/2002 Barber ..... F16F 3/04 267/93
6,484,338 B1 * 11/2002 Hagglund ..... A47C 27/05 5/654.1
6,591,436 B2 * 7/2003 de Santis ..... B68G 9/00 5/655.8
6,826,796 B1 12/2004 Mossbeck
6,829,798 B2 * 12/2004 Wells ..... A47C 27/07 5/655.8
7,048,263 B2 * 5/2006 Ahlqvist ..... B68G 9/00 267/91
7,661,165 B2 * 2/2010 Piccinini ..... A47C 27/146 267/81
8,266,745 B2 * 9/2012 Mossbeck ..... A47C 27/064 5/655.8
8,978,183 B1 * 3/2015 Richmond ..... A47C 27/062 5/655.8
2003/0110566 A1 * 6/2003 Stumpf ..... A47C 27/063 5/655.8
2004/0103479 A1 * 6/2004 Mossbeck ..... A47C 23/0433 5/720
2004/0128773 A1 * 7/2004 Barber ..... A47C 27/062 5/716
2004/0133988 A1 * 7/2004 Barber ..... A47C 27/064 5/716
2004/0172767 A1 * 9/2004 Mossbeck ..... A47C 27/064 5/720
2005/0257883 A1 * 11/2005 Anagnostopoulos A47C 27/063 156/290
2007/0101507 A1 * 5/2007 Grothaus ..... A47C 27/064 5/716
2007/0124865 A1 * 6/2007 Stjerna ..... A47C 27/064 5/720
2007/0289068 A1 * 12/2007 Edling ..... A47C 27/064 5/720
2008/0237948 A1 * 10/2008 Long ..... A47C 23/043 267/95
2010/0011509 A1 * 1/2010 Stjerna ..... A47C 19/04 5/720
2010/0175185 A1 * 7/2010 Davis ..... A47C 23/05 5/247
2016/0007761 A1 * 1/2016 Wolfson ..... A47C 27/07 267/142

* cited by examiner

POCKETED SPRING ASSEMBLY COMPRISING STRINGS OF SPRINGS HAVING Y-SHAPED SEAMS

CROSS REFERENCE TO RELATED APPLICATIONS

This application is a continuation-in-part of U.S. patent application Ser. No. 14/242,077 filed Apr. 1, 2014 entitled "Pocketed Spring Assembly Comprising Strings of Springs Having Y-Shaped Seams and Inserts", which is fully incorporated by reference herein. U.S. patent application Ser. No. 14/242,077 is a continuation-in-part of U.S. patent application Ser. No. 13/921,499 filed Jun. 19, 2013 entitled "Pocketed Spring Assembly Comprising Strings of Springs Having Y-Shaped Seams Separating Adjacent Pockets", which is fully incorporated by reference herein.

TECHNICAL FIELD OF THE INVENTION

This invention relates to bedding and seating products and, more particularly, to pocketed spring assemblies used in bedding and seating products, including mattresses and the method of manufacturing such pocketed spring assemblies.

BACKGROUND OF THE INVENTION

Pocketed spring cores or assemblies are commonly used in seating or bedding products. Such pocketed spring assemblies are commonly made of multiple strings or rows of individually pocketed springs. Adjacent strings of individually pocketed springs are joined together by gluing or otherwise attaching the fabric of the strings of springs to each other.

Pocketed coil springs are often referred to as a Marshall construction in which each coil spring is encased within its own fabric sack or pocket. The sack or pocket is typically defined between two plies of a fabric strip connected together at intervals along transverse lines of attachment spaced along the strip. The two-ply fabric strip is generally formed by folding a strip of double width fabric upon itself along a longitudinal centerline, leaving the overlapped plies along the unjoined opposite edges of the strip to be connected to each other along a longitudinal seam. After the springs are inserted between the plies, opposed plies are joined along transverse lines of attachment to close the pockets and separate adjacent springs.

A variety of techniques have evolved for the manufacture of pocketed springs, some contemplating the creation of the pockets within the fabric plies prior to insertion of the wire spring and others contemplating the insertion of compressed wire springs between the plies of the strip and the subsequent creation of the pockets by joining the two plies to each other along transverse lines of attachment between adjacent springs. In recent times, heat sensitive fabric and ultrasonic welding techniques have been utilized to join the fabric plies together along the seams or lines of attachment.

Most seams separating adjacent individually pocketed springs are linear, such as those disclosed in U.S. Pat. No. 6,826,796. In theory, a load placed upon the pocketed spring moves straight up and down along a vertical axis. However, in reality, the load placed upon a pocketed spring is often angled relative to the axis of the spring. Such an angled load may cause the pocketed spring to try to buckle and create stress on the fabric of the pocket. Over time, the fabric may wear and eventually break, causing the pocketed spring to move outside the pocket.

It is therefore an objective of this invention to provide a seating or bedding product which has a pocketed spring assembly which allows the springs inside the pockets to buckle without stressing the fabric of the pockets.

Still another objective of this invention is to provide a seating or bedding product which has a pocketed spring assembly having increased comfort due to ability of the springs inside the pockets to buckle.

SUMMARY OF THE INVENTION

The invention of this application which accomplishes these objectives comprises a seating or bedding product made from an assembly of pocketed springs, each spring of which is contained within a fabric pocket. The pocketed spring assembly comprises a plurality of strings of springs which may extend longitudinally or transversely in the product.

One primary advantage of pocketed spring assemblies utilizing the present invention is that the construction of the strings of springs allows individually pocketed springs placed under load to buckle without damaging the fabric of the strings of springs and return to their original position in the fabric pocket quickly and easily.

According to one aspect of the invention, the bedding or seating product comprises a pocketed spring assembly comprising a plurality of parallel strings of springs which may be joined to each other. In some embodiments the strings of springs may be joined to one or more scrim sheet(s) in addition to each other. In other embodiments the strings of springs may be joined to one or more scrim sheet(s) without being secured to each other. Each of the strings of springs comprises a plurality of interconnected pockets, each of the pockets containing at least one spring encased in fabric. The individually pocketed springs may be barrel-shaped springs, hourglass-shaped springs or springs having a uniform diameter. The fabric is joined to itself along a longitudinal seam which may be located along one side of the string of springs. Adjacent individually pocketed springs are separated from each other by a separating seam joining opposed first and second plies. Each of the separating seams may comprise a pair of V-shaped end portions joined together by a linear portion. Cushioning materials may be on at least one side of the product. An upholstered covering may encase the pocketed spring assembly and cushioning materials.

According to another aspect of the invention, a pocketed spring assembly for use in a bedding or seating product comprises a plurality of strings of springs. Each of the strings of springs comprises a piece of fabric joined to itself along a longitudinal seam and multiple spaced separating seams to define a plurality of pockets. Each pocket contains at least one spring. Each of the springs has end turns and central convolutions between the end turns. Opposed plies of the fabric are joined together by the separating seams. The separating seams are shaped such that the end turns of each pocketed spring are closer to the separating seams than the central convolutions of the pocketed spring, such that upon compression of at least a portion of the spring in the pocket, the central convolutions of the spring may expand in the pocket without being inhibited by the separating seams.

According to another aspect of the invention, a pocketed spring assembly for use in a bedding or seating product comprises a plurality of strings of springs. Each of the strings of springs comprises a piece of fabric joined to itself along a longitudinal seam and multiple spaced separating seams to define a plurality of pockets. Each pocket contains at least one spring, each spring having upper and lower end turns and central convolutions between the end turns. Each of the separating seams comprises a linear portion and a pair of branch portions. Each branch portion extends outwardly from the linear portion of the separating seam. The spring assembly is characterized, when a load is placed upon the spring assembly, by the ability of at least some of the central convolutions of the spring to move laterally in the pocket of fabric.

According to another aspect of the invention, a pocketed spring assembly for use in a bedding or seating product comprises a plurality of strings of springs. Each of said strings of springs comprises a plurality of interconnected pocketed springs, each spring of which is contained within a pocket of fabric. Each spring has upper and lower end turns and central convolutions between the end turns. Adjacent individually pocketed springs are separated from each other by at least one separating seam joining first and second plies on opposed sides of the string of springs, each of the separating seams comprising a Y-shaped or U-shaped seam. The pocketed spring assembly is characterized, when a load is placed upon the pocketed spring assembly, by the ability of some of the central convolutions of the spring to move laterally in the pocket of fabric within which the spring is contained and return to their original position upon removal of the load.

According to another aspect of the invention, a pocketed spring assembly constructed in accordance with the present invention may be posturized or have different regions of different firmness. Some of the strings of springs may have separating seams which are different than the separating seams of other strings of springs, thus imparting different firmnesses to the different strings of springs.

According to another aspect of the invention, a bedding or seating product incorporating a pocketed spring assembly constructed in accordance with the present invention may impart an improved "feel" or comfort level to a user due to the construction of the strings of springs. The fabric of the strings of springs may be folded in a manner between the individually pocketed springs in bridging portions of the strings of springs so that the fabric is generally co-planar with the fabric of the pockets inside which the springs reside. Such construction provides a generally smoother surface or surfaces of the pocketed spring assembly and avoids bunched up fabric between the pockets of the strings of springs.

According to another aspect of the invention, any embodiment of bedding or seating product described or shown herein may have a plurality of inserts between adjacent strings of springs. The inserts may be made partially or entirely of foam and/or fiber. The foam may be latex foam, polyurethane foam or "viscoelastic" polyurethane memory foam or any other known foam. Each of the inserts may comprise a unitary piece of foam or multiple pieces or sections of different materials joined together, such as by lamination, for example.

In some embodiments, each insert has a generally rectangular cross-sectional shape. However, the inserts may be cylindrical or any other desired shape.

In some embodiments, perimeter or outermost rows and columns of inserts may be higher than the remainder of the inserts inside the product to provide edge support to the product. Alternatively or additionally, to achieve edge support, the inserts may be different materials, the inserts around the perimeter being firmer than the remainder of the inserts. In other embodiments, all the inserts may be the same height, which may be approximately the same, or a different height as the unloaded or unstressed pocketed springs in the strings of springs.

In order to impart a particular feel or firmness to a particular section of a product, inserts of different materials or heights may be strategically located in order to posturize a product (impart different sections of different firmness). For example, a mattress may have two sections, a firmer section for a male and a softer section for a female, the inserts of the firmer section being firmer than the inserts of the softer section. This is known in the industry as a his/hers mattress. Alternatively, one or more sections may lack inserts while other sections have inserts.

Another advantage of the use of inserts in accordance with the present invention is that a manufacturer may be able to achieve the same "feel" or firmness in a bedding or seating product while using thinner wire for the springs inside the pockets of the strings of springs. The use of thinner wire may save costs and/or ease of manufacture.

These and other objects and advantages of this invention will be more readily apparent from the following description of the drawings, in which:

DETAILED DESCRIPTION OF THE DRAWINGS

Figure 1:
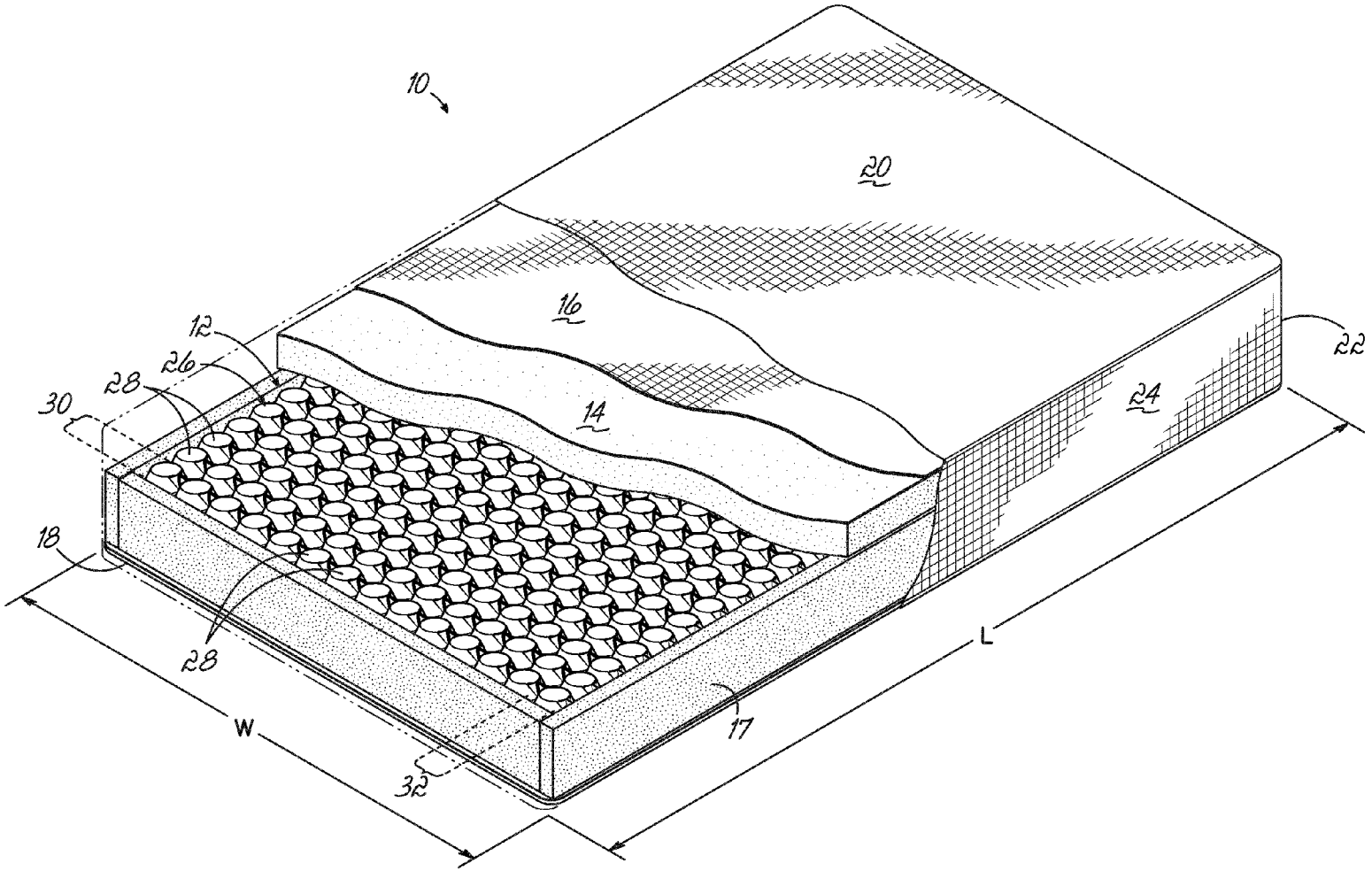
FIG. 1 is a perspective view, partially broken away, of a bedding product incorporating one embodiment of pocketed spring assembly.

With reference to FIG. 1, there is illustrated a bedding product in the form of a single-sided mattress 10 incorporating this invention. This product or mattress 10 comprises a pocketed spring assembly 12 over the top of which there lay conventional padding or cushioning layers 14, 16 which may be foam, fiber, gel or any other suitable materials. The pocketed spring assembly 12 is surrounded with a border 17 made of foam or any other suitable material (only a portion being shown in FIG. 1). Although one type of border 17 is illustrated, the border may assume other forms or shapes of any desired size. Alternatively, the border 17 may be omitted in this embodiment or any embodiment described or shown herein. This complete assembly is mounted upon a base 18 and is completely enclosed within an upholstered covering material 20. The base 18 and border 17 are known in the industry as a "bucket" into which a pocketed spring assembly 12 is inserted before the "bucket" is covered with one or more padding or cushioning layers.

As shown in FIG. 1, fully assembled, the product 10 has a length "L" defined as the linear distance between opposed end surfaces 22 (only one being shown in FIG. 1). Similarly, the assembled product 10 has a width "W" defined as the linear distance between opposed side surfaces 24 (only one being shown in FIG. 1). In the products 10, 10' and 10" shown in FIGS. 1, 1A and 1B, respectively, as well as any of the products shown or described herein, the length is illustrated as being greater than the width. However, it is within the contemplation of the present invention that the length and width may be identical, as in a square product.

Figure 2:
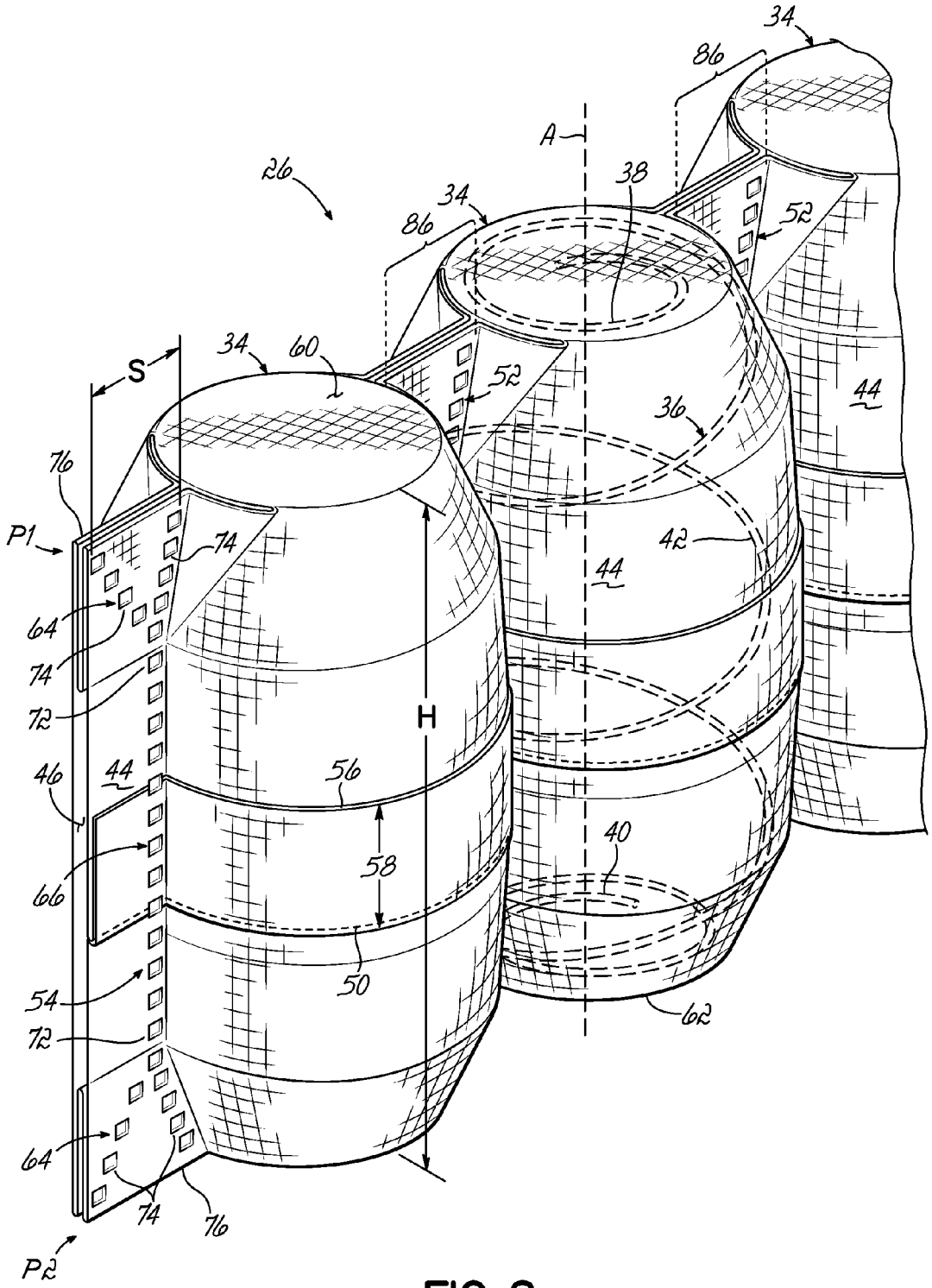
FIG. 2 is an enlarged perspective view of a portion of a string of pocketed coil springs used in the pocketed spring assembly of FIG. 1.
Figure 3:
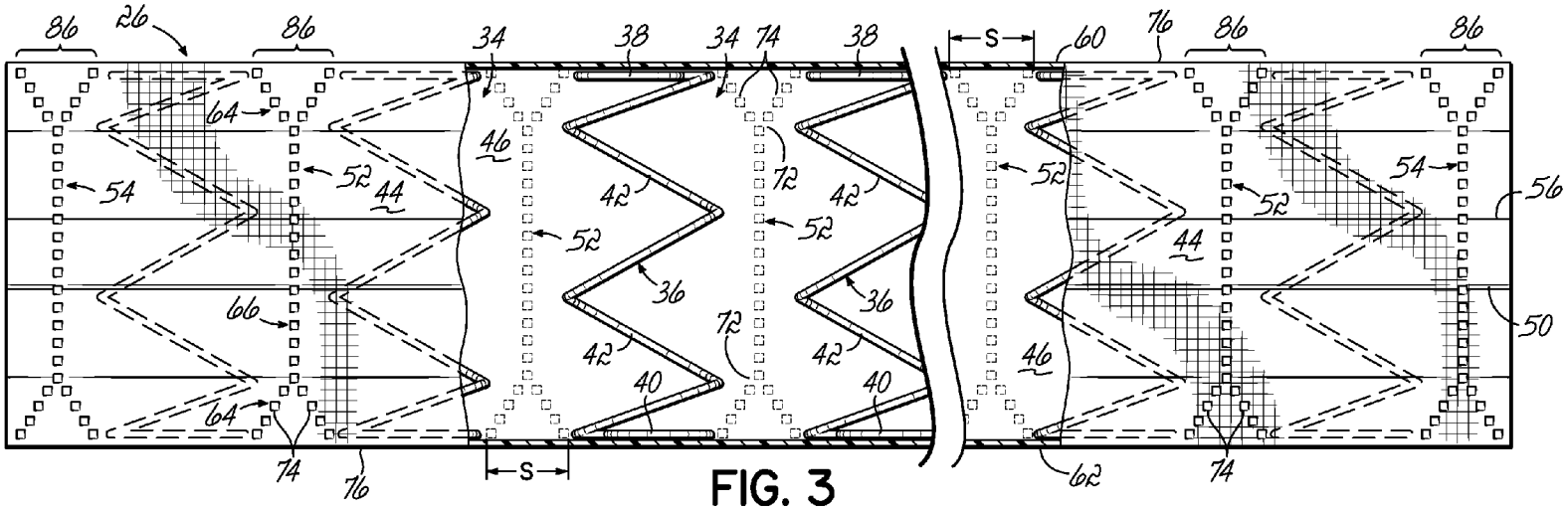
FIG. 3 is a cross-sectional view, partially broken away, of one of the strings of springs of the pocketed spring assembly of FIG. 1.

As shown in the embodiment illustrated in FIGS. 1, 2 and 3, pocketed spring assembly 12 is manufactured from multiple strings of pocketed springs 26 joined together. Each string of pocketed springs 26 extends from side-to-side or transversely across the full width of the product 10. Although the strings of pocketed springs 26 are illustrated as extending transversely or from side-to-side in the pocketed spring assembly 12 of FIG. 1, they may extend longitudinally or from end-to-end in this or any other pocketed spring assembly shown or described herein.

These strings of pocketed springs 26 are connected in side-by-side relationship as, for example, by gluing the sides of the strings together in an assembly machine, so as to create an assembly or matrix of springs having multiple rows and columns of pocketed springs bound together as by gluing, welding or any other conventional assembly process commonly used to create pocketed spring cores or assemblies.

Figure 4:
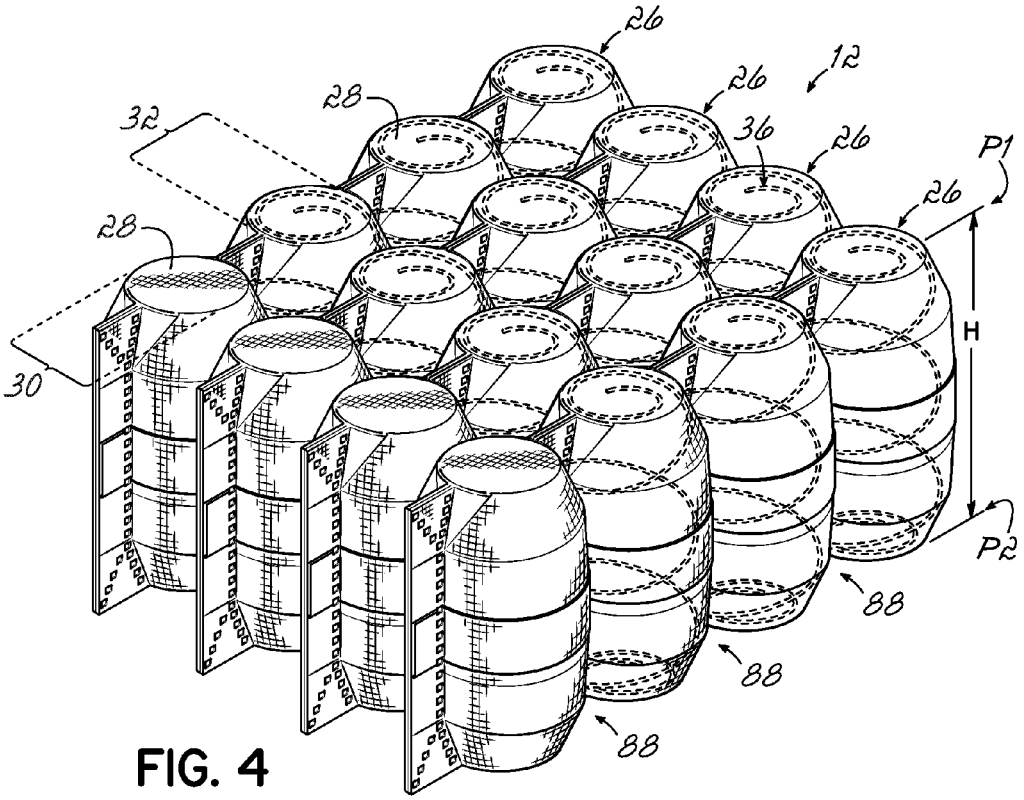
FIG. 4 is an enlarged perspective view of a portion of the pocketed spring assembly of the bedding product of FIG. 1.
Figure 5:
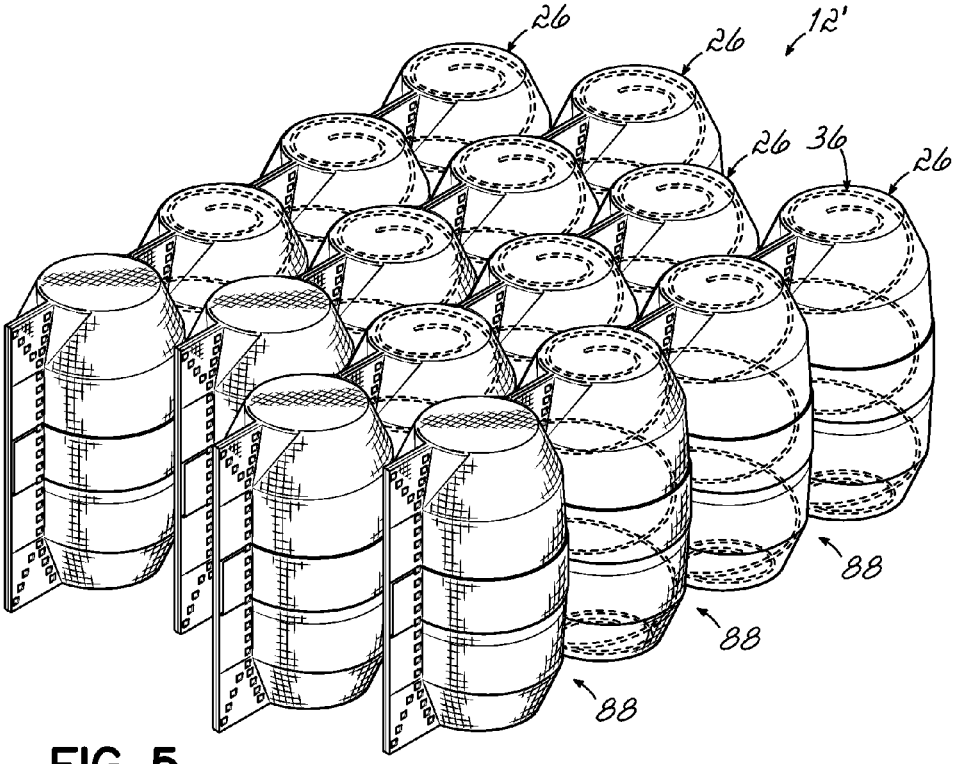
FIG. 5 is an enlarged perspective view of a portion of an alternative embodiment of pocketed spring assembly for use in a bedding or seating product.

As shown in FIGS. 1 and 4, the strings of pocketed springs 26 may be joined so that the individually pocketed springs 28 are aligned in transversely extending rows 30 and longitudinally extending columns 32. Alternatively, as shown in FIG. 5, the strings of pocketed springs 26 may be offset from one another in a pocketed spring assembly 12'. In such an arrangement, the individually pocketed springs 28 are not aligned in rows and columns; instead the individually pocketed springs 28 fill gaps or voids 88 of the adjacent strings of pocketed springs 26.

While the mattress 10 illustrated in FIG. 1 is a single-sided mattress, the pocketed spring assembly 12, or any other pocketed spring assembly shown or described herein, may be incorporated into any bedding or seating product, including a double-sided mattress or seating cushion.

Figure 1A:
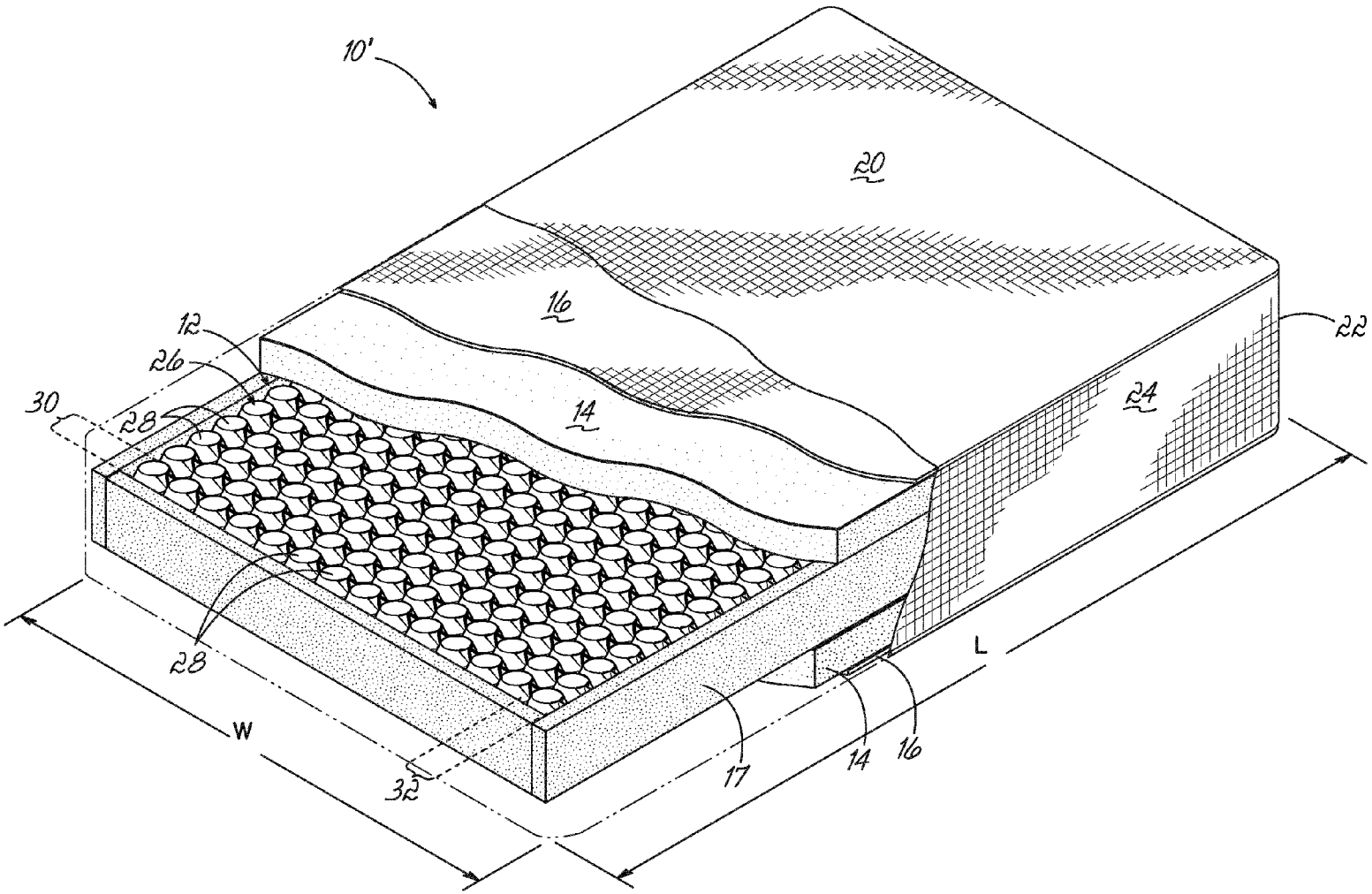
FIG. 1A is a perspective view, partially broken away, of another bedding product incorporating the pocketed spring assembly of FIG. 1.

FIG. 1A illustrates a double-sided mattress 10' comprising a pocketed spring assembly 12 and border 17 identical to those shown in the mattress 10 of FIG. 1. However, the mattress 10' of FIG. 1A has conventional padding layers 14, 16 above and below the pocketed spring assembly 12.

Figure 1B:
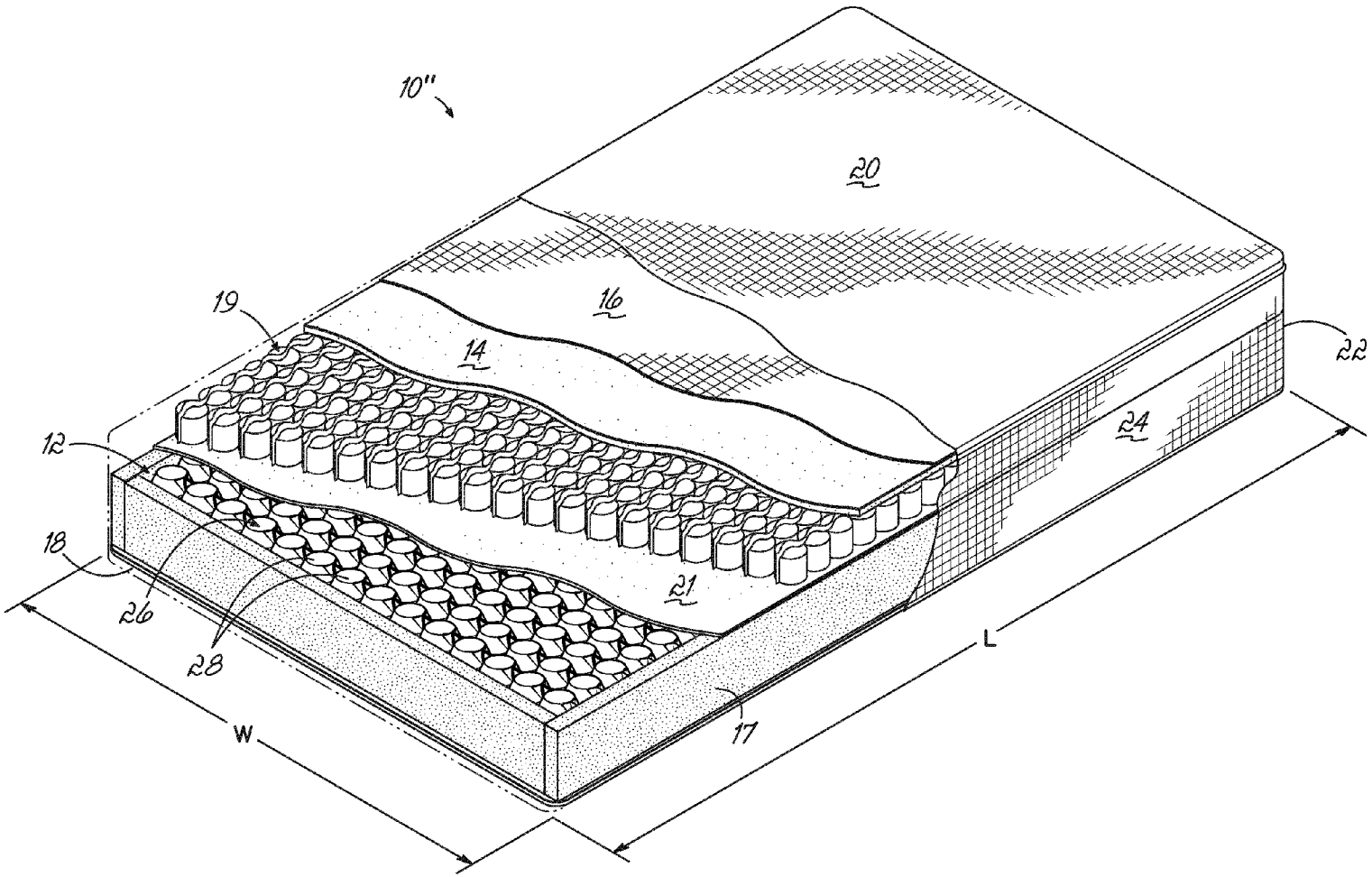
FIG. 1B is a perspective view, partially broken away, of another bedding product incorporating the pocketed spring assembly of FIG. 1.

FIG. 1B illustrates a single-sided mattress 10" comprising a pocketed spring assembly 12 and border 17 identical to those shown in the mattress 10 of FIG. 1. However, the mattress 10" of FIG. 1B has a pocketed topper 19 employing miniature or small strings of pocketed coil springs in addition to padding layers 14, 16 above the pocketed topper 19. A scrim layer 21 separates the pocketed topper 19 from the pocketed spring assembly 12.

According to the practice of this invention, any of the padding or cushioning layers, including the pocketed topper 19, may be omitted in any of the embodiments shown or described herein. The novel features reside in the pocketed spring assembly 12.

As best illustrated in FIGS. 2 and 3, each string of pocketed springs 26 comprises a row of interconnected fabric pockets 34. Each of the fabric pockets 34 contains at least one coil spring 36. As best shown in FIG. 2, each coil spring 36 has a central or longitudinal axis A, an upper end turn 38, a lower end turn 40 and a plurality of central convolutions 42 between the end turns. FIGS. 2 and 3 illustrate a barrel-shaped coil spring 36 in which the diameter of the end turns 38, 40 is less than the diameter of the central convolutions 42, the central convolutions 42 tapering or decreasing in diameter as one moves from the center of the coil spring towards the end turns. However, coil springs in which the diameter of the end turns is identical to the diameter of the central convolutions, or an hourglass-shaped spring in which the diameter of the end turns is greater than the diameter of the central convolutions, may be used in any of the embodiments shown or described herein in accordance with the present invention.

Preferably, one piece of fabric is used to create the string of pocketed springs 26, the piece of fabric being folded over onto itself around the coil springs 36. As best shown in FIGS. 2 and 3, opposite sides or plies 44, 46 of the fabric are sewn, welded or otherwise secured together in order to create a longitudinal seam 50 and a plurality of separating seams 52, including outermost separating seams 54. FIG. 3 illustrates ply 44 being closest to the reader and ply 46 being behind the springs 36.

Although the seams in all of the embodiments shown herein are shown as being spaced rectangles, any of the seams may be spaced dots, triangles or solid line segments without spaces.

Figure 6A:
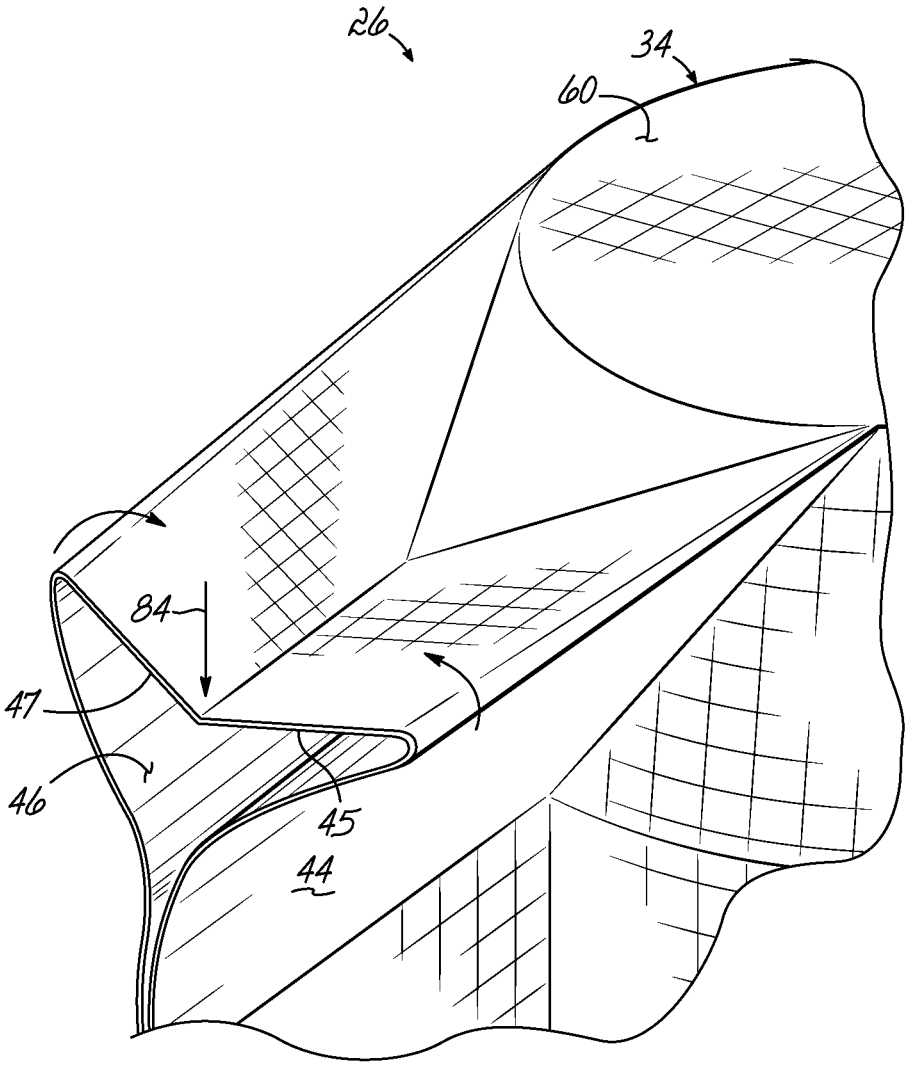
FIG. 6A is an enlarged perspective view of a portion of a string of springs used in the pocketed spring assembly of the bedding product of FIG. 1.
Figure 6B:
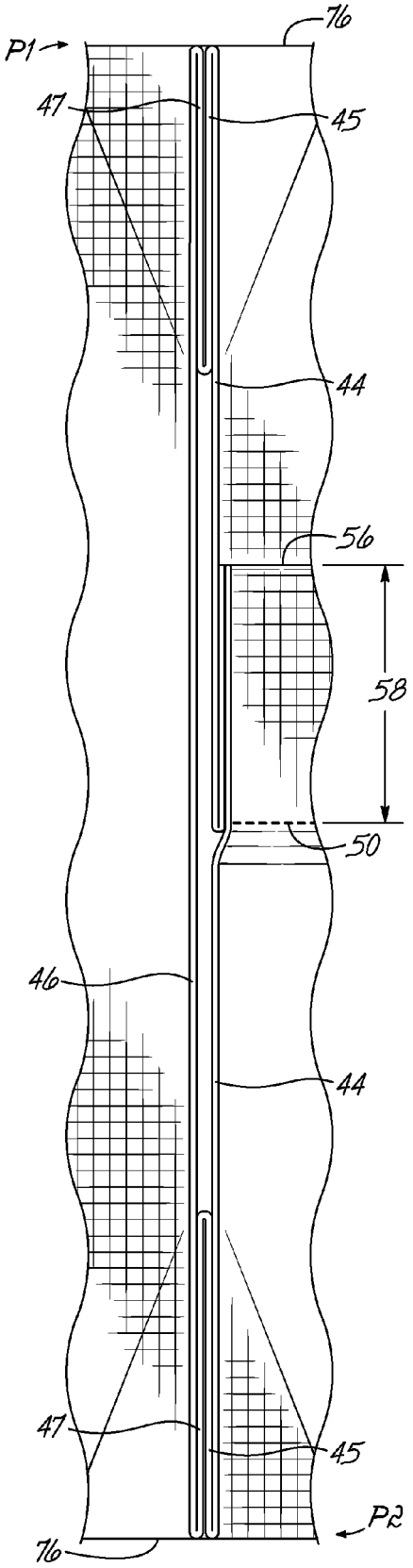
FIG. 6B is a perspective view of a portion of a string of springs used in the pocketed spring assembly of the bedding product of FIG. 1.

As best shown in FIGS. 2 and 6B, opposed edges 56 of the piece of fabric used to create the string of pocketed springs 26 are aligned and spaced from the longitudinal seam 50 a distance indicated by numeral 58. Although the drawings indicate the longitudinal seam 50 being below the free edges 56 of the piece of fabric, the longitudinal seam 50 may be above the free edges 56 of the piece of fabric.

As shown in FIGS. 2 and 3, the string of pocketed springs 26 has a generally planar top surface 60 in a top plane P1 and a parallel generally planar bottom surface 62 in a bottom plane P2. The linear distance between the top and bottom surfaces of the string of pocketed springs 26 defines a height H of the string of pocketed springs 26. This linear distance further defines the height H of the pocketed spring assembly 12 because each of the strings of springs 26 has the same height. However, it is within the scope of the present invention that different strings of springs of a pocketed spring assembly have different heights.

In accordance with one embodiment of the present invention, a separating seam 52 separates adjacent pockets 34 and, therefore, adjacent pocketed springs 28. At each end of the string of springs 26, a separating seam 54, identical to separating seams 52, is formed to hold the outermost springs 36 in place. As best shown in FIGS. 2 and 3, each separating seam 52, 54 comprises a pair of V-shaped end portions 64 and a linear or straight portion 66 joining the V-shaped end portions 64. As best illustrated in FIGS. 2 and 3, from the ends of the linear portion 66 at locations 72, the separating seam 52, 54 diverges or splits into two diverging branches or legs 74. At their ends, the branches 74 are separated by a linear distance "S" along the top and bottom edges 76 of the string of springs 26 between the individual pockets 34. As further described herein, the greater the linear distances "S" between the branches 74 of the end portions 64 of separating seams 52, 54 of a string of springs, the softer the feel of a spring assembly or portion of a spring assembly made from such strings of springs. As best illustrated in FIGS. 2 and 3, the triangular region, bridging portion or bridge 86 between the branches 74 of each of the end portions 64 of each of the separating seams 52, 54 within a string of springs 26 comprises four plies created by tucking the fabric downwardly as shown in FIG. 6A before the plies are welded to create the separating seams 52, 54. This process enables the upper and lower surfaces 60, 62 of the string of springs 26 to be generally planar in planes P1 and P2 without the fabric between the individually pocketed springs extending above and below the upper and lower surfaces 60, 62 of the string of springs 26.

Figure 5A:
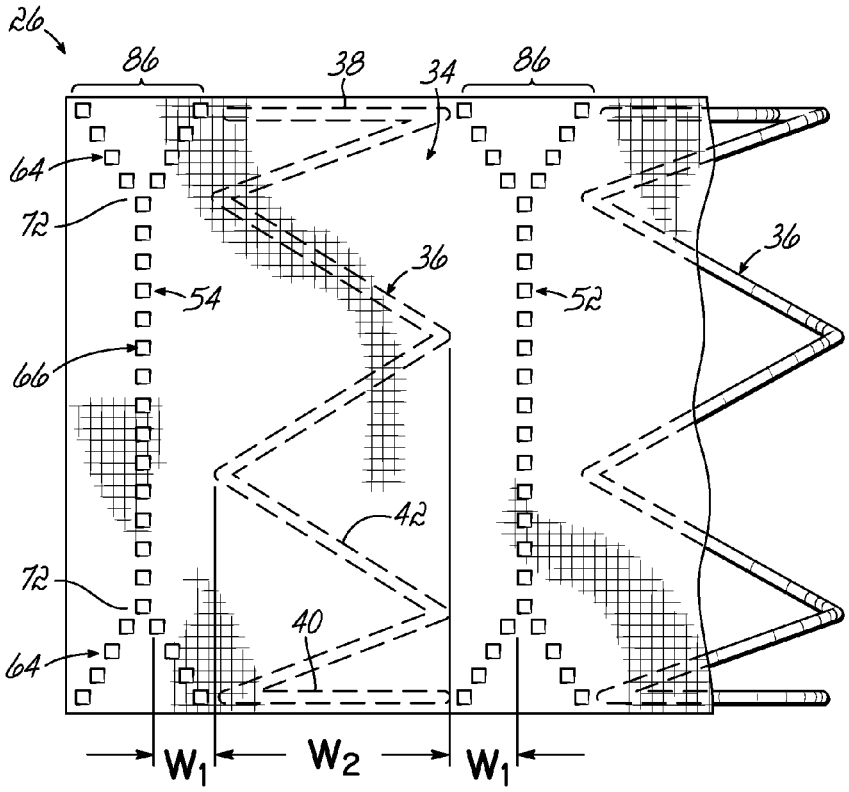
FIG. 5A is a cross-sectional view of a portion of a string of springs used in the bedding product of FIG. 1 without any load on the string of springs.

FIGS. 5A-5D illustrates one primary advantage of the present invention. Although these drawings show one configuration of coil spring inside the pockets of a string of springs, other coil springs, such as barrel-shaped coil springs, may be used. The advantages of the present invention, as shown and described herein, apply to pocketed spring assemblies made from strings of pocketed springs using any of the coil springs described or shown herein. Due to the unique configuration of the separating seams 52, 54, the end turns 38, 40 of coil springs 36 inside pockets 34 of strings of springs 26 return to their original position inside the pocket 34 after compression or loading of the pocketed coil springs 36. As shown in FIG. 5A, due to the V-shaped end portions 64 of the separating seams 52, 54 on opposite sides of the pocket 34, the end turns 38, 40 of coil spring 36 inside the pocket 34 abut the V-shaped end portions 64 of the separating seams 52, 54, on opposite sides of the pocket 34. As shown in FIG. 5A, the end turns 38, 40 and central convolutions 42 of pocketed coil spring 36, have the same diameter or width W2, which is approximately the same linear distance between the ends of the V-shaped end portions 64 of adjacent separating seams 52, 54, on opposite sides of the pocket 34. The end turns 38, 40 of coil spring 36 remain trapped between the ends of the V-shaped end portions 64 of the separating seams 52, 54, on opposite sides of the pocket 34 when the coil spring 36 is uncompressed or not loaded, as shown in FIG. 5A.

Referring to FIG. 5A, the central convolutions 42 of pocketed coil spring 36 are spaced a linear distance W1 from the linear portions 66 of adjacent separating seams 52, 54, on opposite sides of the pocket 34 when the pocketed coil spring 36 is at rest (under no load).

Figure 5B:
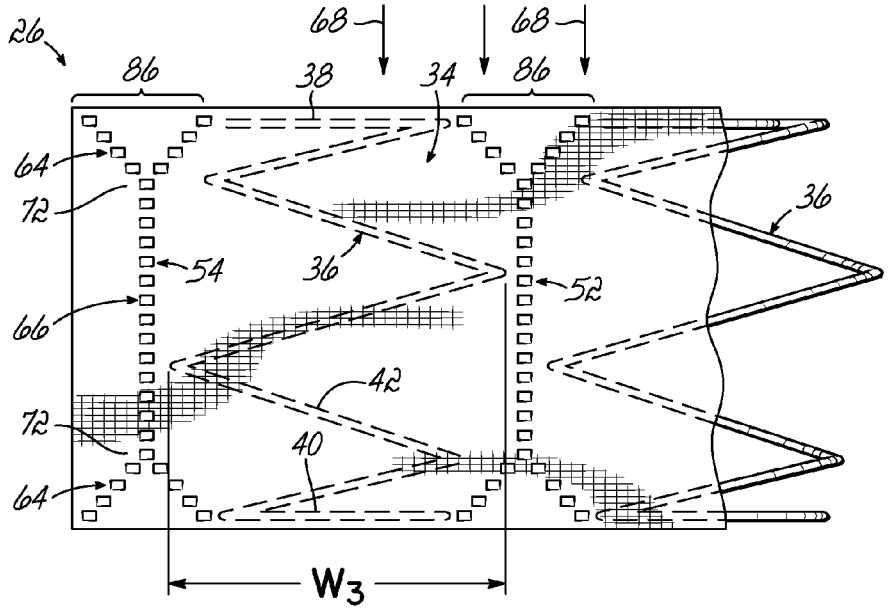
FIG. 5B is a cross-sectional view of the portion of the string of springs of FIG. 5A with a load on the string of springs.

As shown in FIG. 5B, when a load indicated by arrows 68 is placed upon the pocketed coil spring 36, the central convolutions 42 of pocketed coil spring 36 increase in diameter or expand to a diameter or linear distance W3, which is greater than the diameter or distance W2 of FIG. 5A. Due to the linear distances W1 on opposite sides of the pocket 34, upon being loaded, at least some of the central convolutions 42 of pocketed coil spring 36 have room to expand in the pocket 34 without stressing the adjacent separating seams 52, 54, on opposite sides of the pocket 34. In its compressed condition shown in FIG. 5B, end turns 38, 40 of pocketed coil spring 36 remain trapped between the ends of the V-shaped end portions 64 of the separating seams 52, 54, on opposite sides of the pocket 34.

Figure 5C:
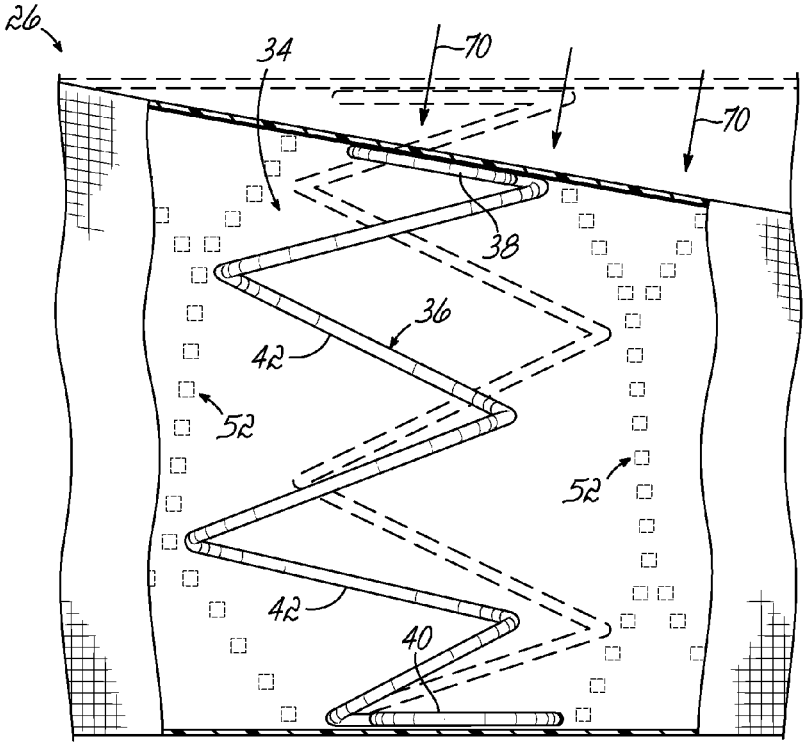
FIG. 5C is a cross-sectional view of the portion of the string of springs of FIG. 5A with an angled load on the string of springs.

As shown in FIG. 5C, when an angled load indicated by arrows 70 is placed upon the pocketed coil spring 36, the central convolutions 42 of pocketed coil spring 36 have room to buckle or move laterally, as well as increase in diameter inside the pocket 34, without stressing either of the separating seams 52, 54 on opposite sides of the pocket 34. Due to the linear distances W1 on opposite sides of the pocket 34, upon being loaded, the pocketed coil spring 36 has room to move from an unloaded condition or position shown in dashed lines to a loaded condition or position shown in solid lines without stressing either of the separating seams 52, 54, on opposite sides of the pocket 34. In its condition shown in FIG. 5C, end turns 38, 40 of pocketed coil spring 36 remain trapped between the ends of the V-shaped end portions 64 of the separating seams 52, 54, on opposite sides of the pocket 34 and do not move relative to the material of the pocket.

Figure 5D:
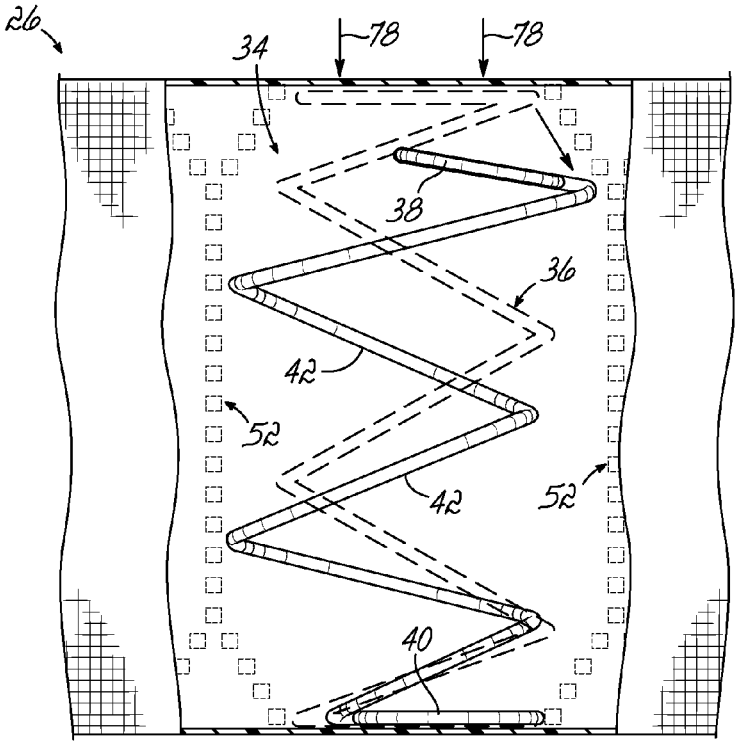
FIG. 5D is a cross-sectional view of the portion of the string of springs of FIG. 5A showing travel of a spring inside a pocket.

As shown in FIG. 5D, in the event a person puts a load, indicated by arrows 78, on a specific area of a pocketed spring assembly, such as putting an elbow or knee on the pocketed spring assembly, the upper end turn 38 of pocketed coil spring 36 may move downwardly from a position shown in dashed lines to a position shown in solid lines. Due to the unique configuration of the V-shaped end portions 64 of separating seams 52 (or 54) on opposite sides of the pocket 34, when the load is removed, the upper end turn 38 of pocketed coil spring 36 is guided by the branches or legs 74 of the end portion 64 back to its original position. In its "at rest" condition shown in dashed lines in FIG. 5D, end turns 38, 40 of pocketed coil spring 36 remain trapped between the ends of the V-shaped end portions 64 of the separating seams 52, 54, on opposite sides of the pocket 34.

Figure 2A:
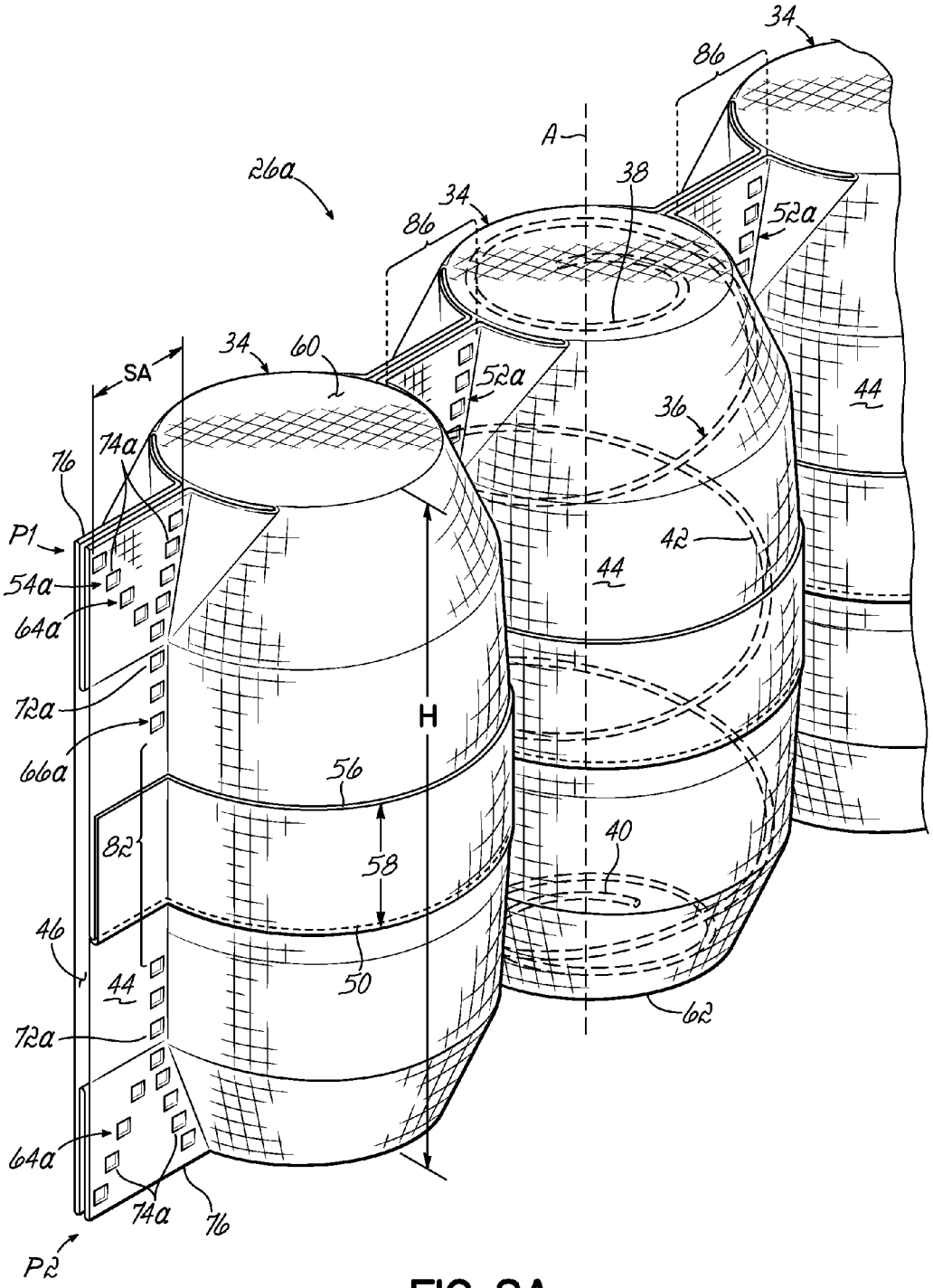
FIG. 2A is an enlarged perspective view of a portion of an alternative string of pocketed coil springs which may be used in accordance with the present invention.
Figure 3A:
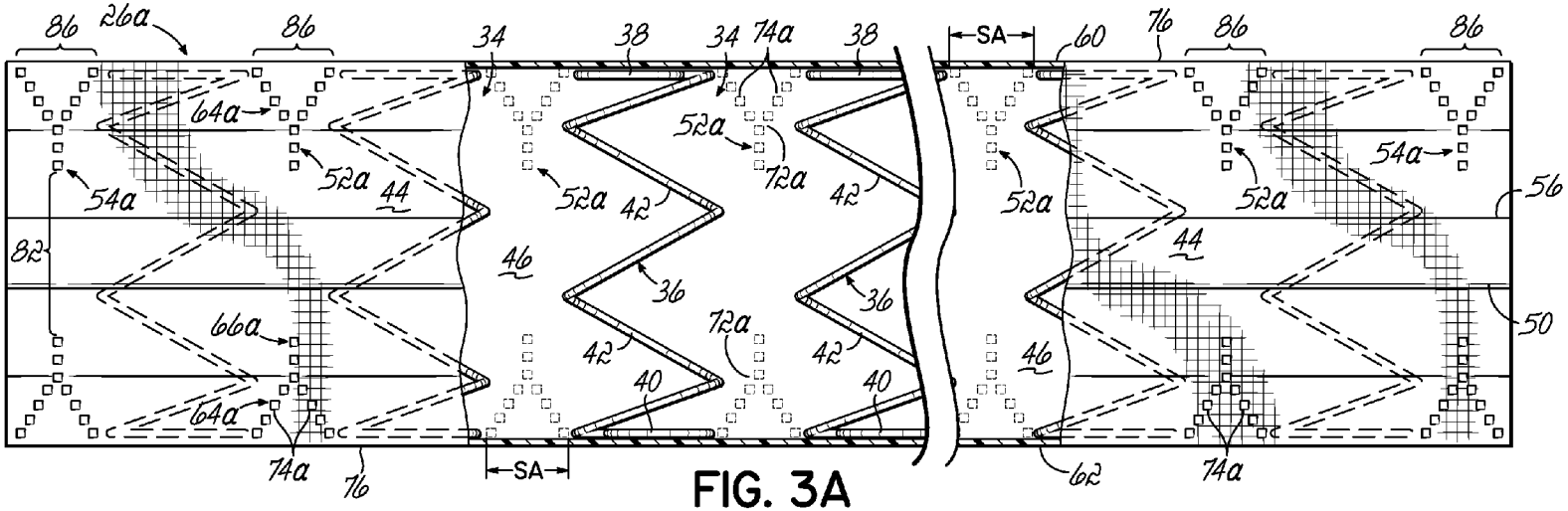
FIG. 3A is a perspective view, partially broken away, of an alternative string of springs for use in a pocketed spring assembly.

FIGS. 2A and 3A illustrate an alternative string of springs 26*a* which may be used in any of the embodiments or products shown or described herein. String of springs 26*a* is identical to string of springs 26 except that two spaced separating seams 52*a* separate adjacent pockets 34 and, therefore, adjacent pocketed springs 36. At each end of the string of springs 26*a*, two separating seams 54*a* identical to separating seams 52*a* are formed to hold the outermost springs 36 in place in accordance with the present invention. As best shown in FIGS. 2A and 3A, each separating seam 52*a*, 54*a* is generally Y-shaped. Each Y-shaped separating seam 52*a*, 54*a* comprises a V-shaped end portion 64*a* and a stem or linear or straight portion 66*a*. A gap 82 exists with no seam between the two Y-shaped separating seams 52*a*, 54*a* separating adjacent pockets 34 and pocketed springs 36. More particularly, the gap 82 is defined as the linear distance between the ends of the linear or straight portions 66*a* of the two Y-shaped separating seams 52*a*, 54*a* separating adjacent pockets 34 and pocketed springs 36. As best illustrated in FIGS. 2A and 3A, from the ends of the linear or straight portion 66*a* at location 72*a*, the separating seam 52*a*, 54*a* diverges or splits into two branches 74*a*. At their ends, the branches 74*a* are separated by a linear distance "SA" along the top and bottom edges 76 of the string of springs 26*a* between the individual pockets 34. As further described herein, the greater the linear distances "SA" of the triangular regions or bridges 86 between the branches 74*a* of each of the end portions 64*a* of each of the separating seams 52*a*, 54*a* within a string of springs 26*a*, the softer the feel of a spring assembly or portion of a spring assembly made from the strings of springs. This is true in any of the embodiments of strings of springs shown or described herein.

Figure 3B:
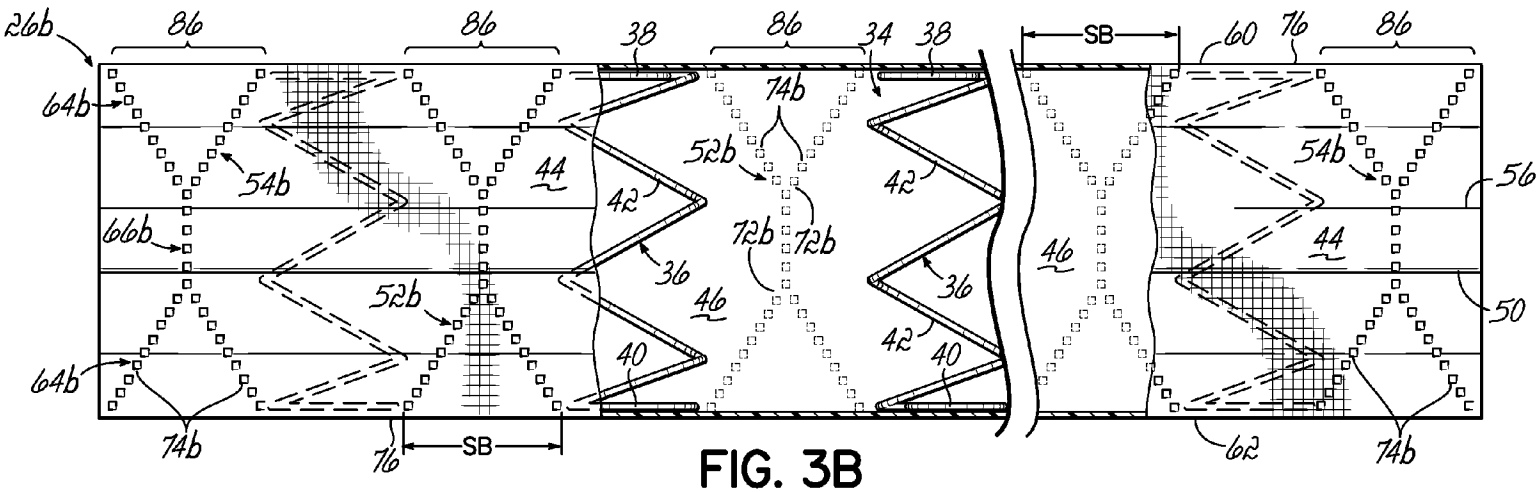
FIG. 3B is a perspective view, partially broken away, of an alternative string of springs for use in a pocketed spring assembly.

FIG. 3B illustrates an alternative string of springs 26*b*, which may be used in any of the embodiments or products shown or described herein. String of springs 26*b* is identical to string of springs 26, except for the separating seams 52*b*, 54*b* separating adjacent pockets 34 and, therefore, adjacent pocketed springs 36. At each end of the string of springs 26*b*, two separating seams 54*b* identical to separating seams 52*b* are formed to hold the outermost springs 36 in place in accordance with the present invention. As best shown in FIG. 3B, each separating seam 52*b*, 54*b* comprises a pair of V-shaped end portions 64*b* and a linear or straight portion 66*b* joining the V-shaped end portions 64*b*. As best illustrated in FIGS. 2 and 3, from the ends of the linear or straight portion 66*b* at locations 72*b*, each separating seam 52*b*, 54*b* diverges or splits into two branches 74*b*. At their ends, the branches 74*b* are separated by a linear distance "SB" along the top and bottom edges 76 of the string of springs 26*b* between the individual pockets 34. As further described herein, the greater the linear distances "SB" between the individually pocketed springs of a string of springs, the softer the feel of a pocketed spring assembly or portion of a pocketed spring assembly made from the strings of springs. For example, a pocketed spring assembly or portion of a pocketed spring assembly made from string of springs 26*b* would be "softer" or less firm than a pocketed spring assembly or portion of a pocketed spring assembly made from string of springs 26 because, at least in part, linear distances "SB" between the individually pocketed springs of strings of springs 26*b* are greater than the linear distances "S" between the individually pocketed springs of strings of springs 26 shown in FIG. 3.

Figure 3C:
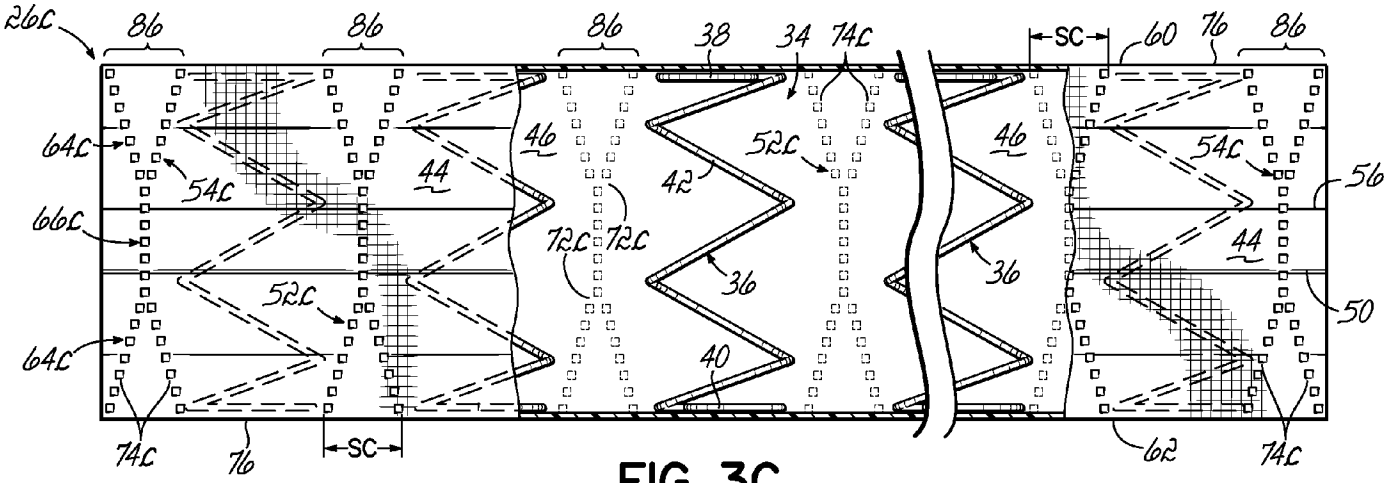
FIG. 3C is a perspective view, partially broken away, of an alternative string of springs for use in a pocketed spring assembly.

FIG. 3C illustrates an alternative string of springs 26*c* which may be used in any of the embodiments or products shown or described herein. String of springs 26*c* is identical to string of springs 26, except for the separating seams 52*c*, 54*c* separating adjacent pockets 34 and, therefore, adjacent pocketed springs 28. At each end of the string of springs 26*c*, two separating seams 54*c* identical to separating seams 52*c* are formed to hold the outermost springs 36 in place in accordance with the present invention. As best shown in FIG. 3C, each separating seam 52*c*, 54*c* comprises a pair of V-shaped end portions 64*c* and a linear or straight portion 66*c* joining the V-shaped end portions 64*c*. As best illustrated in FIG. 3C, from the ends of the linear or straight portion 66*c* at locations 72*c*, each separating seam 52*c*, 54*c* diverges or splits into two branches 74*c*. At their ends, the branches 74*c* are separated by a linear distance "SC" along the top and bottom edges 76 of the string of springs 26*c* between the individual pockets 34. The linear distance "SC" between the ends of the branches 74*c* is approximately the same as the linear distance "S" between ends of the branches 74 of separating seams 52, 54 of string of springs 26 shown in FIGS. 2 and 3. However, the depth of the V-shaped end portions 64*c* of the separating seams 52*c*, 54*c* of the string of springs 26*c* is greater than the depth of the V-shaped end portions 64 of the separating seams 52, 54 of the string of springs 26.

Figure 3D:
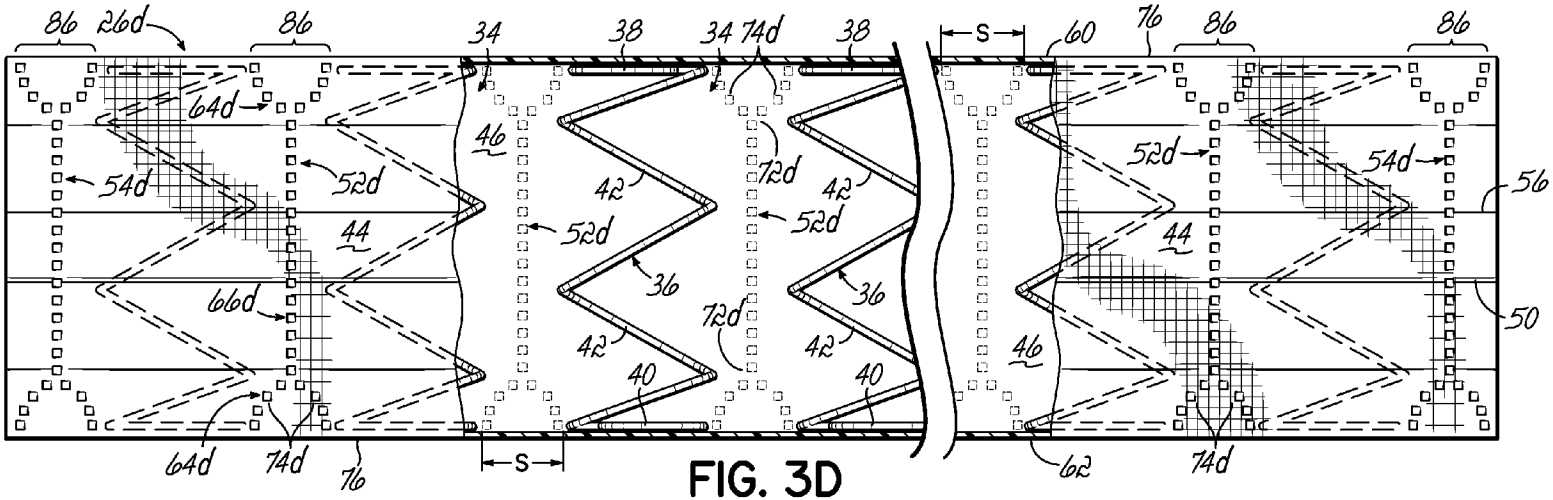
FIG. 3D is a perspective view, partially broken away, of an alternative string of springs for use in a pocketed spring assembly.

FIG. 3D illustrates an alternative string of springs 26*d* which may be used in any of the embodiments or products shown or described herein. String of springs 26*d* is identical to string of springs 26, except for the separating seams 52*d*, 54*d* separating adjacent pockets 34 and, therefore, adjacent pocketed springs 36. At each end of the string of springs 26*d*, two separating seams 54*d* identical to separating seams 52*d* are formed to hold the outermost springs 36 in place in accordance with the present invention. As best shown in FIG. 3D, each separating seam 52*c*, 54*c* comprises a pair of U-shaped end portions 64*d* and a linear or straight portion 66*d* joining the U-shaped end portions 64*d*. As best illustrated in FIG. 3D, from the ends of the linear or straight portion 66*d* at locations 72*d*, each separating seam 52*d*, 54*d* diverges or splits into two branches 74*d*. At their ends, the branches 74*d* are separated by a linear distance "S" along the top and bottom edges 76 of the string of springs 26*d* between the individual pockets 34. The linear distance "S" between the ends the of branches 74*d* is approximately the same as the linear distance "S" between ends of the branches 74 of separating seams 52, 54 of string of springs 26 shown in FIGS. 2 and 3. However, the shape of the end or branch portions 64*d* of the separating seams 52*d*, 54*d* of the string of springs 26*d* is U-shaped, rather than the V-shaped end or branch portions 64 of the separating seams 52, 54 of the string of springs 26, shown in FIG. 3.

Figure 3E:
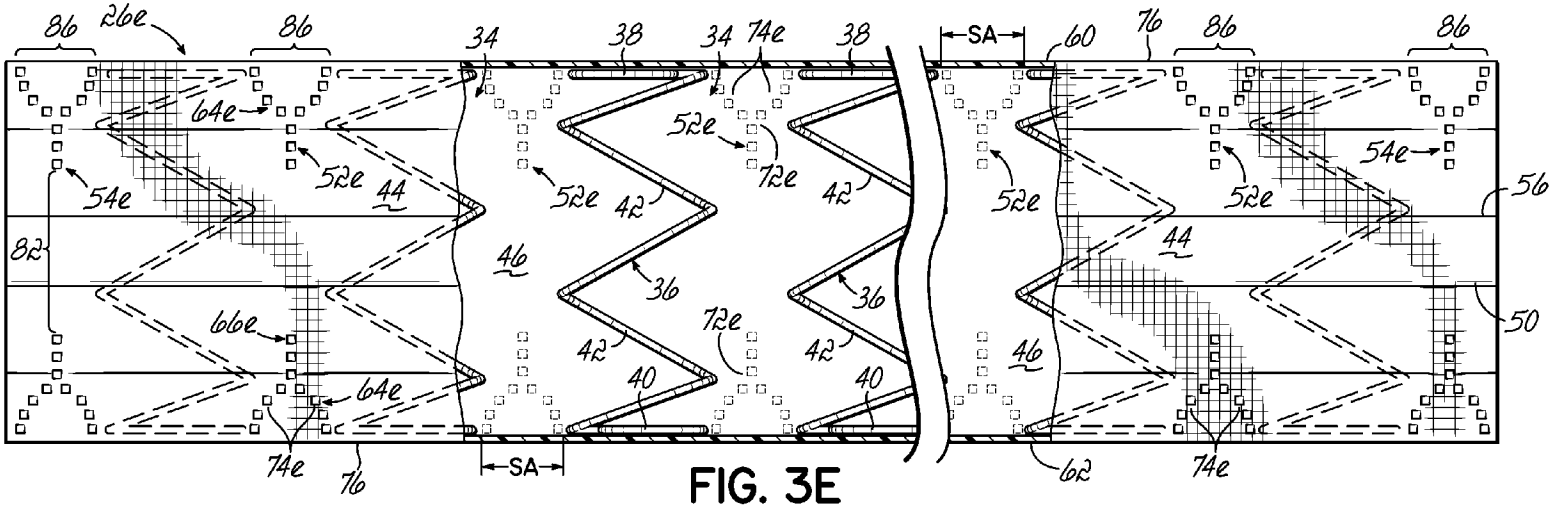
FIG. 3E is a perspective view, partially broken away, of an alternative string of springs for use in a pocketed spring assembly.

FIG. 3E illustrates an alternative string of springs 26*e*, which may be used in any of the embodiments or products shown or described herein. String of springs 26*e* is identical to string of springs 26*a*, except for the separating seams 52*e*, 54*e* separating adjacent pockets 34 and, therefore, adjacent pocketed springs 36. At each end of the string of springs 26*e*, two separating seams 54*e* identical to separating seams 52*e* are formed to hold the outermost springs 36 in place in accordance with the present invention. As best shown in FIG. 3E, each separating seam 52*e*, 54*e* comprises a U-shaped end portion 64*e* and a stem or linear or straight portion 66*e* extending inwardly from the U-shaped end portion 64*e*. As best illustrated in FIG. 3E, from the end of the linear or straight portion 66*e* at location 72*e*, each separating seam 52*e*, 54*e* diverges or splits into two branches 74*e*. At their ends, the branches 74*e* are separated by a linear distance "SA" along the top and bottom edges 76 of the string of springs 26*e* between the individual pockets 34.

FIGS. 6A and 6B illustrate another feature of the string of springs 26. As shown in FIG. 6A, the piece of fabric used to create the string of springs 26 is folded downwardly in the direction of arrow 84 between adjacent pockets 34 so that the fabric does not extend above the upper surface 60 of the string of springs 26. This folding of the fabric between adjacent pockets 34 creates an area or region of four plies, two plies 44, 45 being formed from the material of the first ply 44 and two other plies 46, 47 being formed from the material of the second ply 46. As shown in FIG. 6B, this folding of the fabric between adjacent pockets 34 creates upper and lower edges 76, which are located generally in the planes P1 and P2 of the string of springs 26, as shown in FIG. 2.

Figure 7:
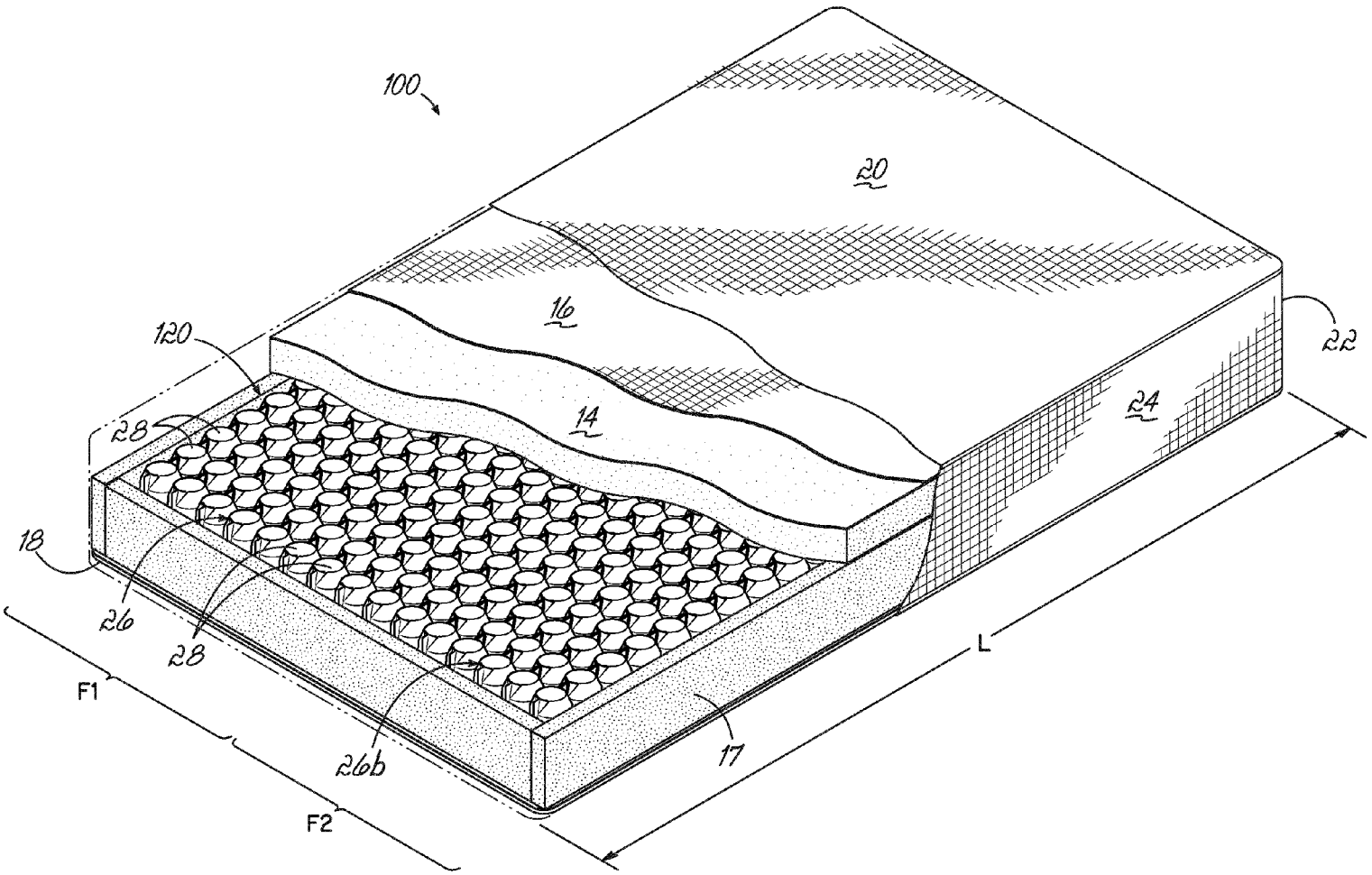
FIG. 7 is a perspective view, partially broken away, of a bedding product incorporating another embodiment of pocketed spring assembly in accordance with the present invention.

FIG. 7 illustrates an alternative embodiment of bedding product 100. This product 100 is illustrated as being a single-sided product, like the mattress or bedding product 10 of FIG. 1. However, the pocketed spring assembly 120 is different than the pocketed spring assembly 12 used in the mattress 10. The pocketed spring assembly 120 of this embodiment is posturized or has different regions of different firmness due to the constructions of the strings of springs used in the pocketed spring assembly 120. Although illustrated only in a single-sided mattress, such a posturized pocketed spring assembly 120 may be incorporated into any of the bedding or seating products described or illustrated herein.

As illustrated in FIG. 7, the pocketed spring assembly 120 has a plurality of longitudinally extending strings of springs 26, 26*b* joined together. The pocketed spring assembly 120 of the mattress 100 has a "firm" side or region F1 and a "soft" side or region F2, the "firm" portion F1 being firmer than the "soft" portion F2, due to the construction of the strings of springs making up each side, portion or region. For example, the "firm" side F1 of pocketed spring assembly 120 may comprise strings of springs 26 shown in FIGS. 2 and 3, while the "soft" side F2 of pocketed spring assembly 120 may comprise strings of springs 26*b* shown in FIG. 3B. Because the linear distance "SB" of the triangular regions or bridges 86 between the branches 74*b* of each of the end portions 64*b* of each of the separating seams 52*b*, 54*b* of strings of springs 26*b* is larger than the linear distance "S" of the triangular regions or bridges 86 between the branches 74 of each of the end portions 64 of each of the separating seams 52, 54 of strings of springs 26, the firmness of the group of connected strings of springs 26*b* in section F2 of pocketed spring assembly 120 is less firm or "softer" than the firmness of the group of connected strings of springs 26 in section F1 of pocketed spring assembly 120. Although FIG. 7 is illustrated with strings of springs 26, 26*b*, any of the strings of springs shown or described herein may be used in a posturized pocketed spring assembly, like the pocketed spring assembly 120.

Figure 8:
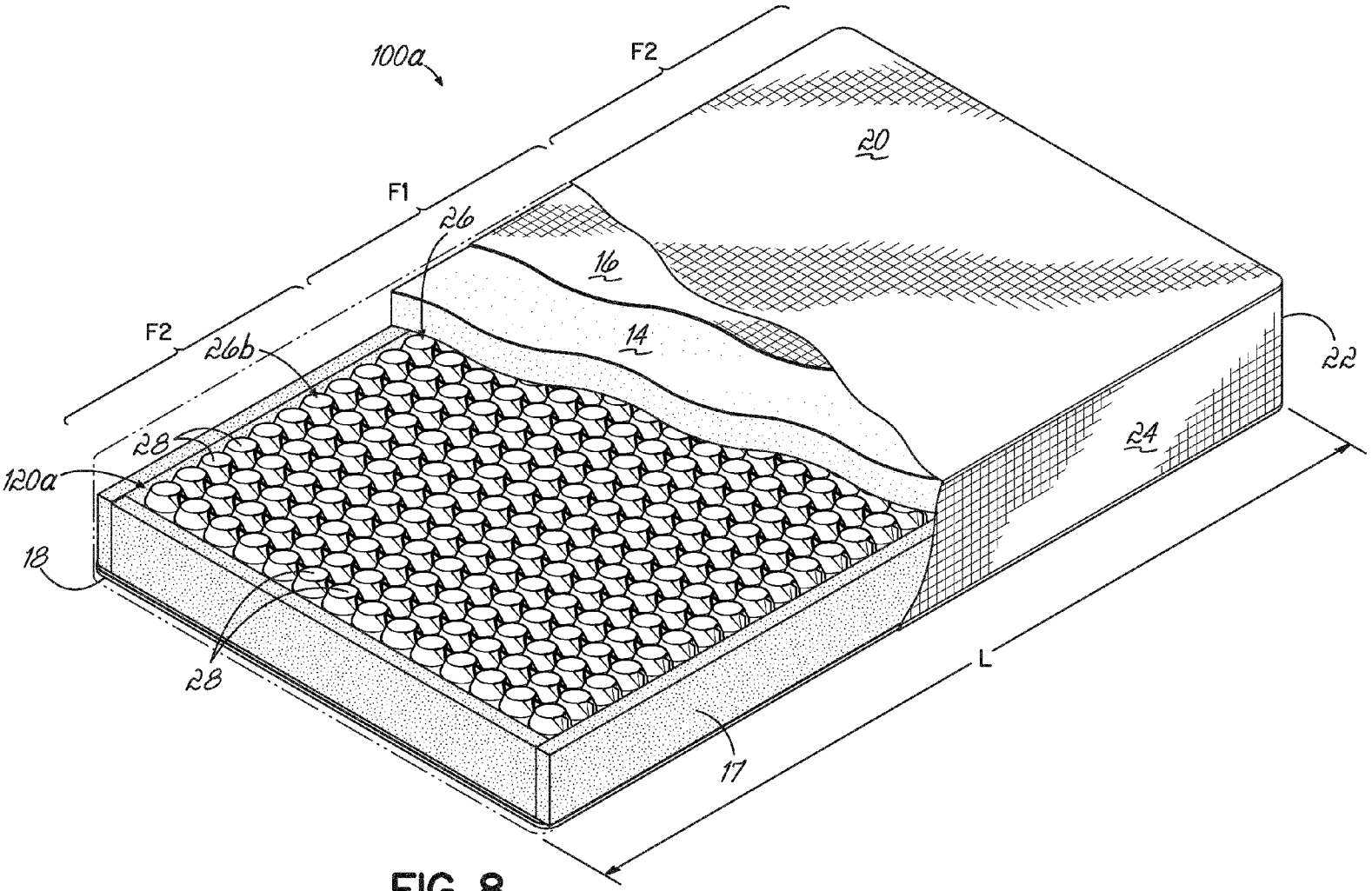
FIG. 8 is a perspective view, partially broken away, of a bedding product incorporating another embodiment of pocketed spring assembly.

FIG. 8 illustrates another alternative embodiment of bedding product 100*a*. This product 100*a* is illustrated as being a single-sided product, like the mattress or bedding product 10 of FIG. 1. However, the pocketed spring assembly 120*a* is different than the pocketed spring assembly 12 used in the mattress 10. The pocketed spring assembly 120*a* of this embodiment is posturized or has different regions of different firmness due to the constructions of the strings of springs used in the pocketed spring assembly 120*a*. Although illustrated only in a single-sided mattress, such a posturized pocketed spring assembly 120*a* may be incorporated into any of the bedding or seating products described or illustrated herein.

As illustrated in FIG. 8, the pocketed spring assembly 120*a* has a plurality of transversely extending strings of springs 26, 26*b* joined together. The pocketed spring assembly 120*a* of the mattress 100*a* has a "firm" area or region F1 and two "soft" areas or regions F2 on opposite sides of the firm region F1, the "firm" portion F1 being firmer than the "soft" portions F2, due to the construction of the strings of springs making up each portion or region F1, F2. For example, the "firm" region F1 of pocketed spring assembly 120*a* may comprise strings of springs 26 shown in FIGS. 2 and 3, while the "soft" regions F2 of pocketed spring assembly 120*a* may comprise strings of springs 26*b* shown in FIG. 3B. Because the linear distance "SB" of the triangular regions or bridges 86 between the branches 74*b* of each of the end portions 64*b* of each of the separating seams 52*b*, 54*b* of strings of springs 26*b* is larger than the linear distance "S" of the triangular regions or bridges 86 between the branches 74 of each of the end portions 64 of each of the separating seams 52, 54 of strings of springs 26, the firmness of the group of connected strings of springs 26*b* in sections F2 of pocketed spring assembly 120*a* is less firm or "softer" than the firmness of the group of connected strings of springs 26 in section F1 of pocketed spring assembly 120*a*. Although FIG. 8 is illustrated with strings of springs 26, 26*b*, any of the strings of springs shown or described herein may be used in a posturized pocketed spring assembly, like the pocketed spring assembly 120*a*.

Figure 9:
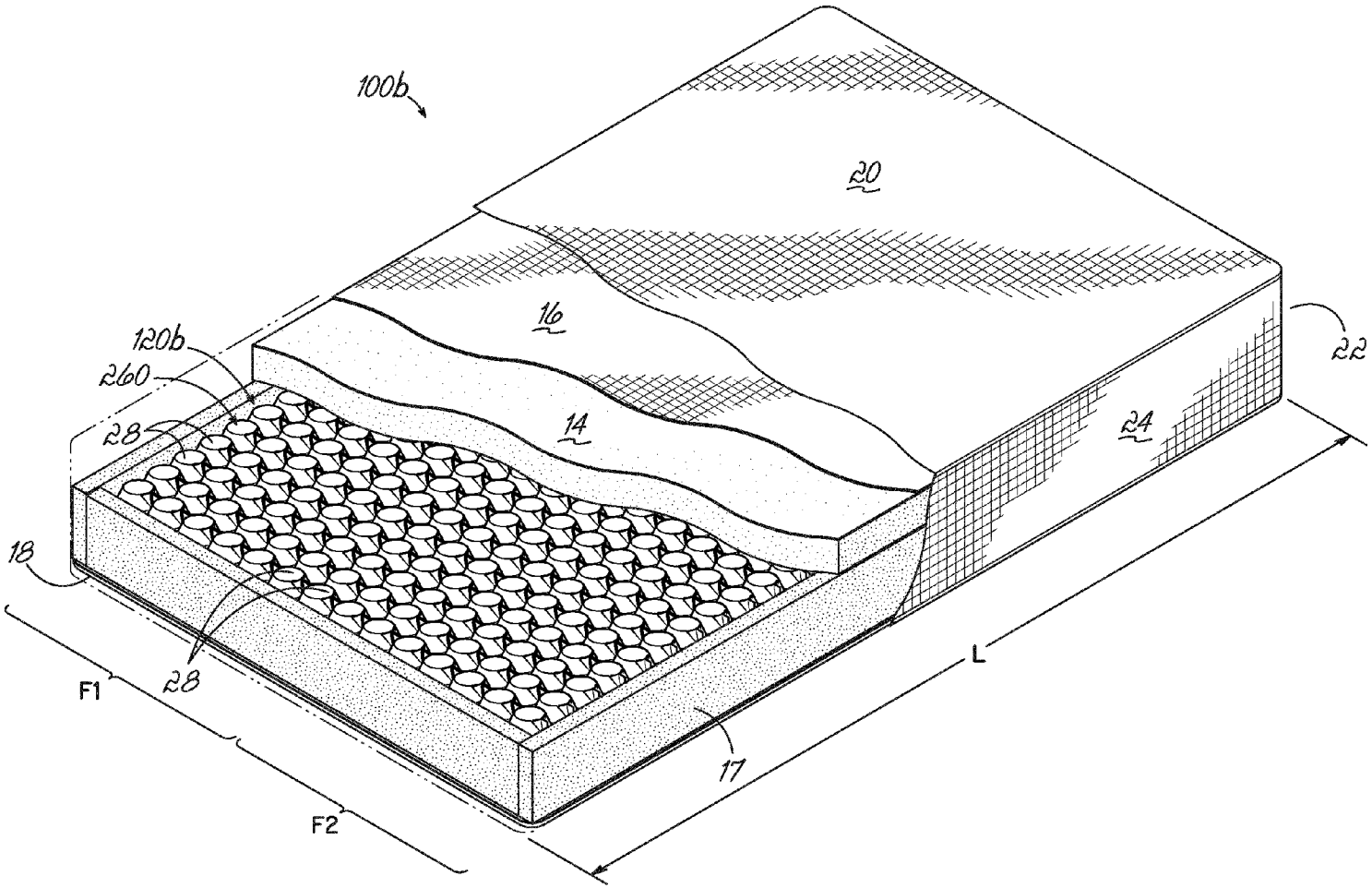
FIG. 9 is a perspective view, partially broken away, of a bedding product incorporating another embodiment of pocketed spring assembly.

FIG. 9 illustrates an alternative embodiment of bedding product 100*b*. This product 100*b* is illustrated as being a single-sided product, like the mattress or bedding product 10 of FIG. 1. However, the pocketed spring assembly 120*b* is different than the pocketed spring assembly 12 used in the mattress 10. The pocketed spring assembly 120*b* of this embodiment is posturized or has different regions of different firmness due to the constructions of the strings of springs used in the pocketed spring assembly 120*b*. Although illustrated only in a single-sided mattress, such a posturized pocketed spring assembly 120*b* may be incorporated into any of the bedding or seating products described or illustrated herein.

Figure 10:
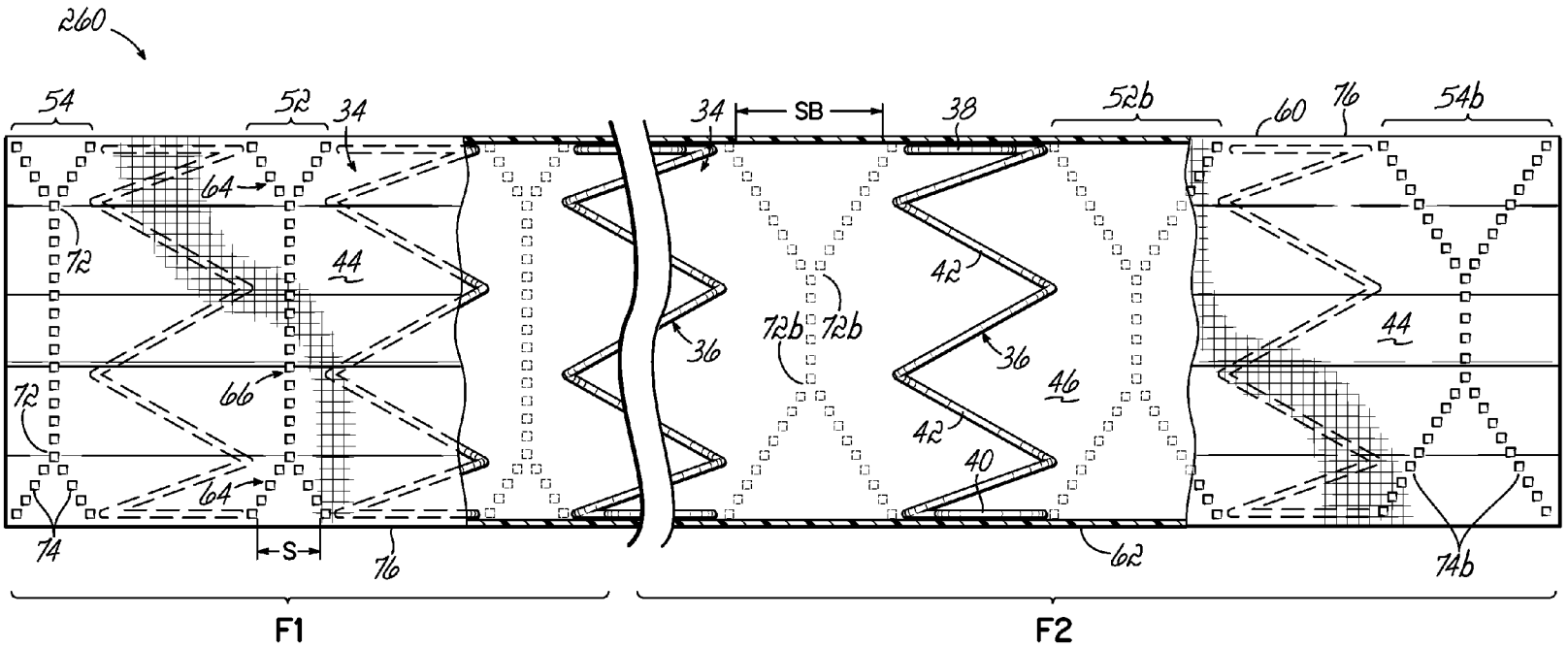
FIG. 10 is a cross-sectional view, partially broken away, of a string of springs used in the product of FIG. 9.

As illustrated in FIG. 9, the pocketed spring assembly 120*b* has a plurality of transversely extending strings of springs 260 joined together. One of these strings of springs 260 is illustrated in detail in FIG. 10. The pocketed spring assembly 120*b* of the mattress 100*b* has a "firm" side or region F1 and a "soft" side or region F2, the "firm" portion F1 being firmer than the "soft" side or portion F2, due to the construction of the strings of springs 260 making up the pocketed spring assembly 120*b*. Each of the transversely extending strings of springs 260 is identical, but has different separating seams therein. As shown in FIG. 10, each string of springs 260 has a "firm" side F1 and a "soft" side F2 due to different separating seams 52, 52*b* being incorporated into each of the strings of springs 260. Because the linear distance "SB" of the separating seams 52*b* of portion F2 of strings of springs 260 is larger than the linear distance "S" of the separating seams 52 of portion F1 of strings of springs 260, the firmness of one side or portion F1 of the string of springs 260 is greater than the firmness of the other side or portion F2 of the string of springs 260. Even though the pocketed spring assembly 120*b* is made up of identical strings of springs 260 joined together, the pocketed spring assembly 120*b* is posturized or has regions of different firmness. The same side (section F2) of each of the strings of springs 260 of pocketed spring assembly 120*b* is less firm or "softer" than the other side of each of the strings of springs 260 (section F1) of pocketed spring assembly 120. Although the string of springs 260 illustrated in FIG. 10 has two separating seams 52, 52*b*, any of the separating seams shown or described herein may be used in such a posturized string of springs to create a posturized pocketed spring assembly, like the pocketed spring assembly 120*b*.

Figure 11:
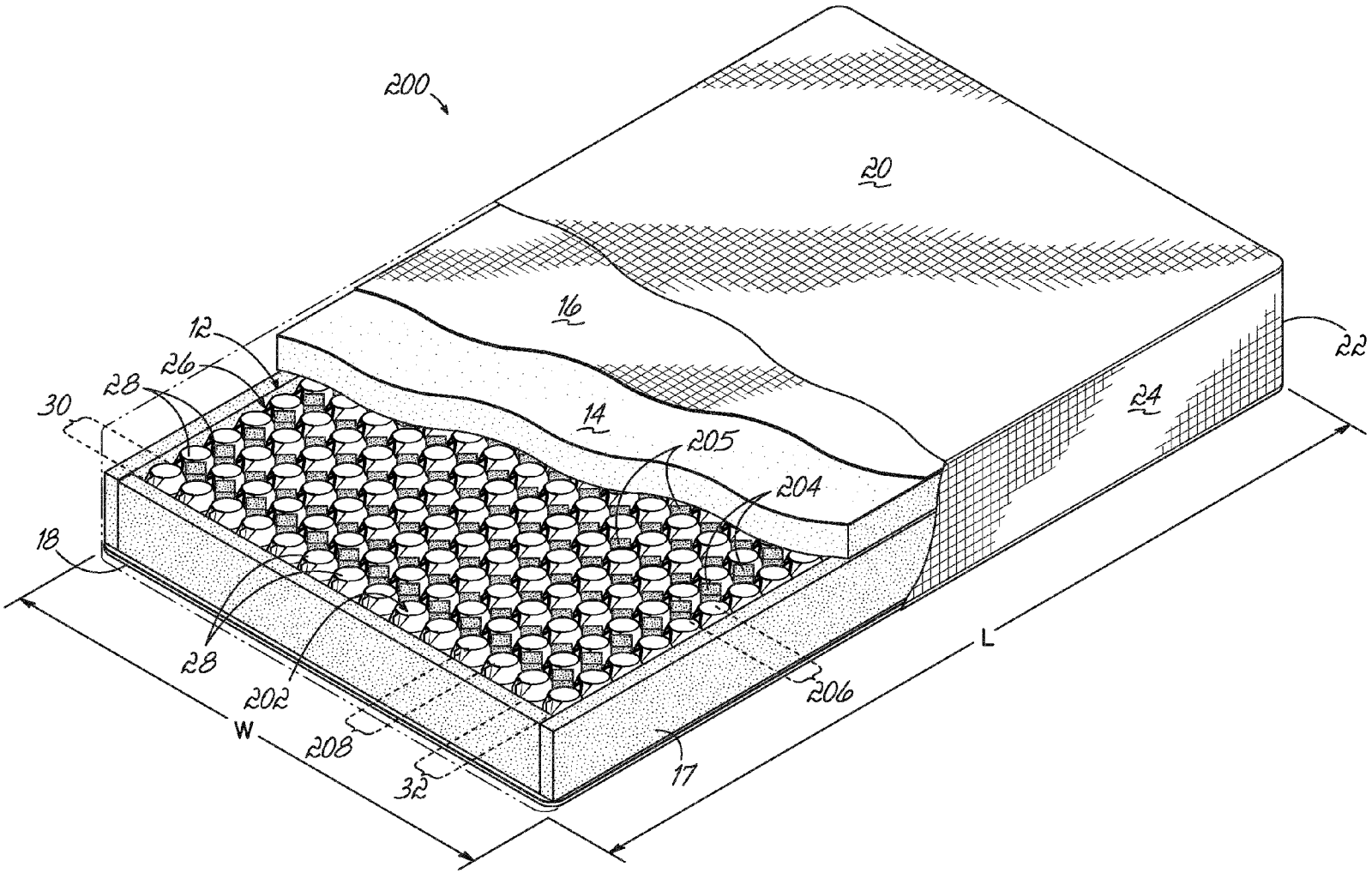
FIG. 11 is a perspective view, partially broken away, of an alternative embodiment of bedding or seating product.
Figure 12A:
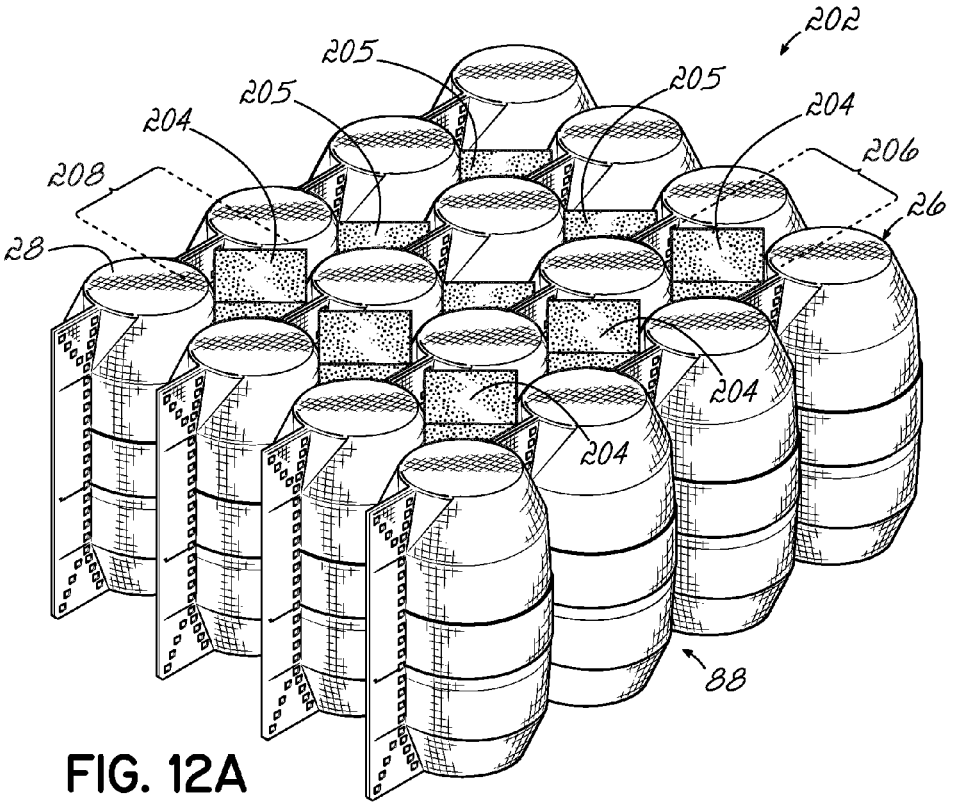
FIG. 12A is an enlarged perspective view of a portion of the interior of the product of FIG. 11.
Figure 12B:
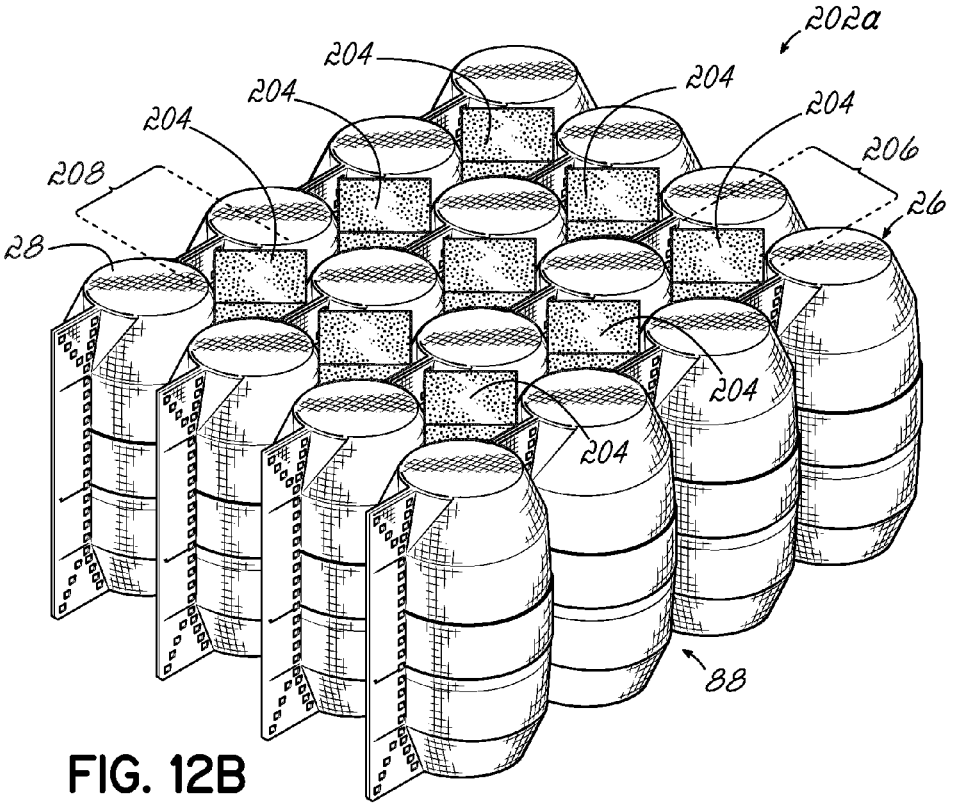
FIG. 12B is an enlarged perspective view of a portion of an alternative interior of a bedding or seating product.
Figure 12C:
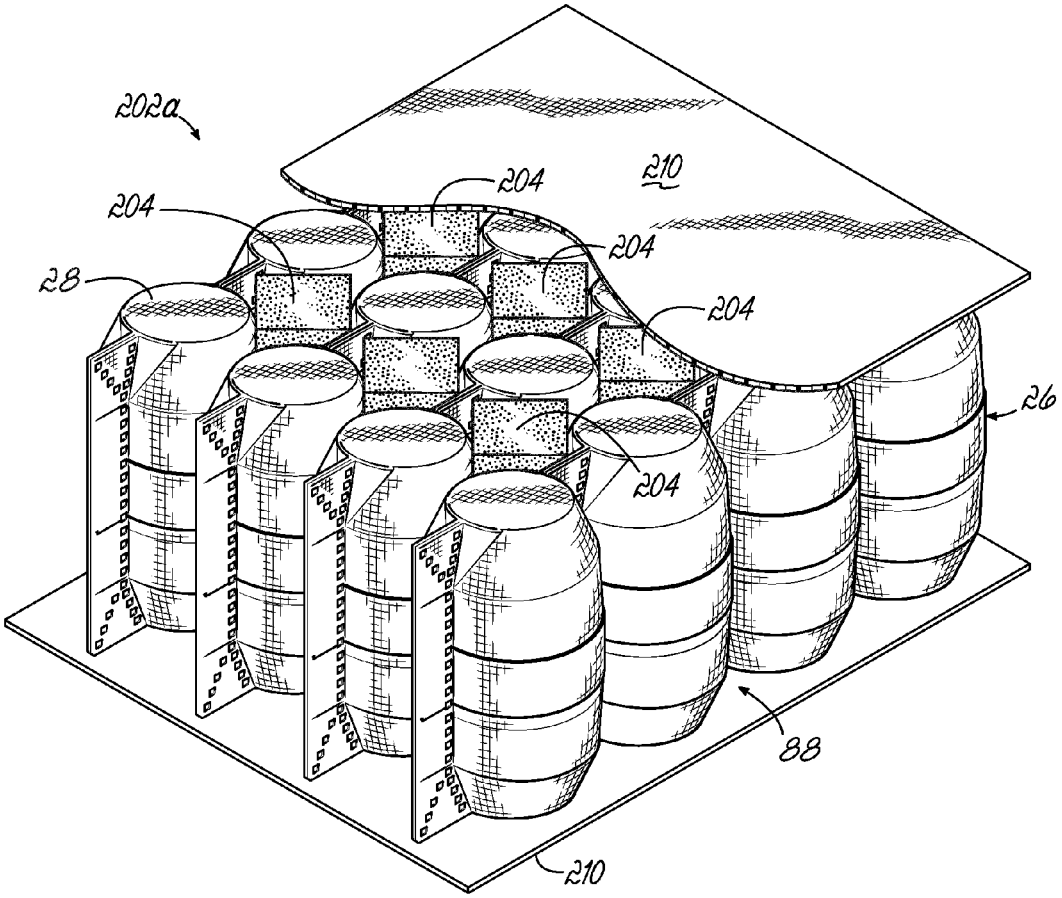
FIG. 12C is an enlarged perspective view of a portion of an alternative interior of a bedding or seating product.

FIG. 11 illustrates an alternative embodiment of bedding product or mattress 200. This product 200 is illustrated as being a single-sided product, like the mattress or bedding product 10 of FIG. 1. For simplicity, the same parts have the same numbers in the different embodiments. The interior 202 of the bedding product or mattress 200 is different than the interior of the mattress or bedding product 10 of FIG. 1 and other interiors of products shown or described herein due to the addition of inserts 204, 205. The strings of springs 26 may be joined to each other as in the other embodiments. However, in addition, multiple inserts 204, 205 are inserted into voids between adjacent strings of springs 26. As shown in FIGS. 12A-12C, inserts 204, 205 are arranged in transversely extending rows 206 and longitudinally extending columns 208.

Although the pocketed spring assembly 12 of the bedding product or mattress 200 is identical to the pocketed spring assembly 12 used in the mattress 10, the bedding product or mattress 200 has a different "feel" or firmness due to the presence of the multiple inserts 204, 205 in the bedding product or mattress 200. Therefore, the bedding product or mattress 200 has a greater firmness than the firmness of the mattress or bedding product 10 of FIG. 1 due to the addition of the inserts 204, 205 in the bedding product or mattress 200, everything else being equal. However, a bedding manufacturer may be able to use a thinner wire for the pocketed springs in the strings of springs 26 of bedding product or mattress 200 than the wire used for the pocketed springs in the strings of springs 26 of bedding product or mattress 10, due to the addition of the inserts 204, 205. Although the drawings show an insert in every void, it is within the contemplation of the present invention that only select voids be filled with an insert of a desirable height and/or material. For example, inserts may be located only around the perimeter of the product for edge support. Being able to use thinner wire for the individually pocketed springs may be desirable from a cost perspective, for ease of manufacturing and other reasons. Although illustrated only in a single-sided mattress 20, any number of inserts 204, 205 of any desired material(s) and/or size may be incorporated into any of the bedding or seating products described or illustrated herein in any desired locations.

Figure 13A:
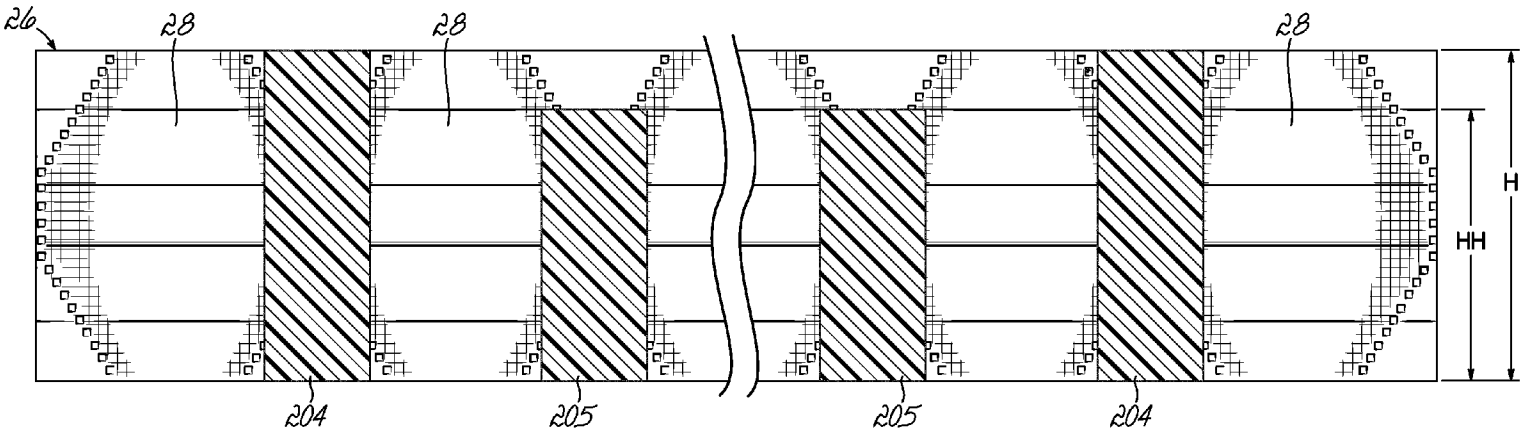
FIG. 13A is a cross-sectional view, partially broken away, of a portion of the interior of the product of FIG. 11.

FIG. 12A illustrates a corner (the leftmost corner shown in FIG. 11) of the interior 202 of the bedding product or mattress 200 shown in FIG. 11. In this embodiment of mattress 200, the outermost two longitudinally extending columns 208 along the sides and the two outermost transversely extending rows 206 along the ends of inserts 204 are a height H approximately the same height as the height H of the pocketed springs 28 of the strings of springs 26. See FIG. 2. As shown in FIGS. 12A and 13A, the interior inserts 205 are of a height "HH" less than the height H of the perimeter inserts 204.

Figure 13B:
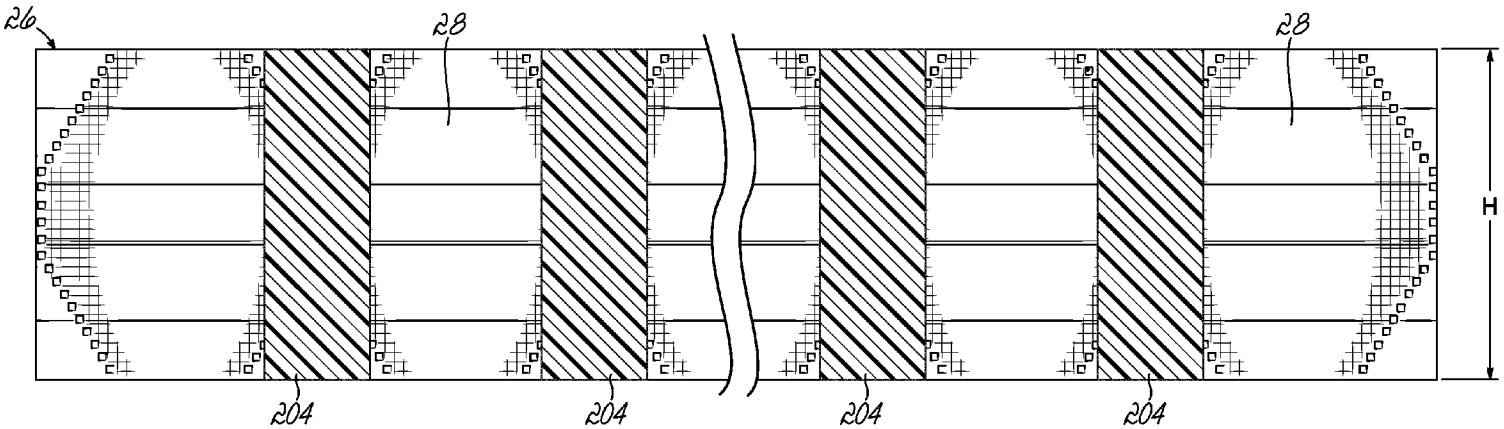
FIG. 13B is a cross-sectional view, partially broken away, of a portion of an alternative interior of a bedding or seating product like that shown in FIG. 12B.

FIGS. 12B and 13B illustrate a corner like the corner shown in FIG. 12A of the interior 202*a* of another embodiment of bedding product or mattress like the bedding product or mattress 200 shown in FIG. 11. In this embodiment of mattress, all of the inserts 204, including the perimeter inserts, are a height H approximately the same height as the height H of the pocketed springs 28 of the strings of springs 26. See FIG. 2. As shown in FIGS. 12B and 13B, the interior inserts 204 are of the same height as the height H of the perimeter inserts 204. If desired, as explained above, the perimeter inserts may be made of a different material to increase the firmness of the perimeter inserts compared to the interior inserts to provide edge support or edge firmness.

FIG. 12C illustrates the interior 202*a* of a mattress or bedding product with the addition of upper and lower scrim sheets 210. Some or all of the strings of springs 26, along with some or all the inserts 204, may be secured to at least one of the upper and lower scrim sheets 210 in any desired manner, including the use of adhesive. If desired, only the strings of springs 26 may be secured to at least one of the scrim sheets 210. In some applications, only one scrim sheet may be used.

Figure 12D:
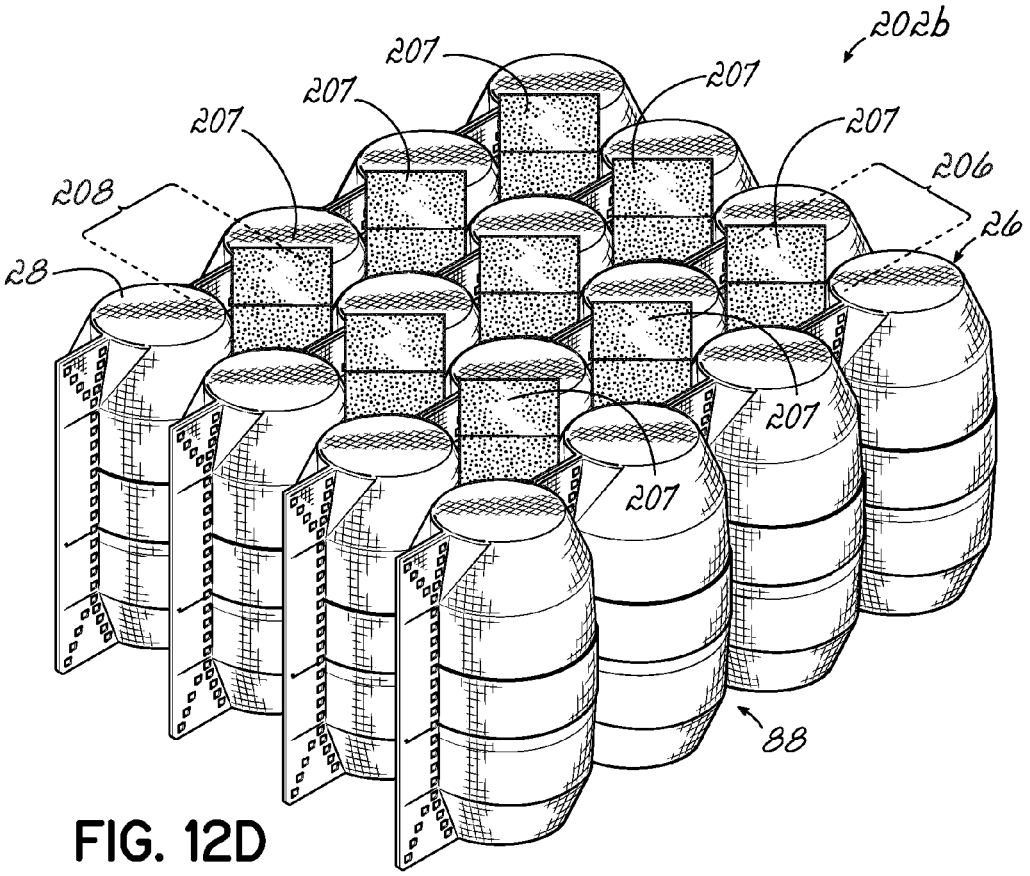
FIG. 12D is an enlarged perspective view of a portion of an alternative interior of a bedding or seating product.
Figure 12E:
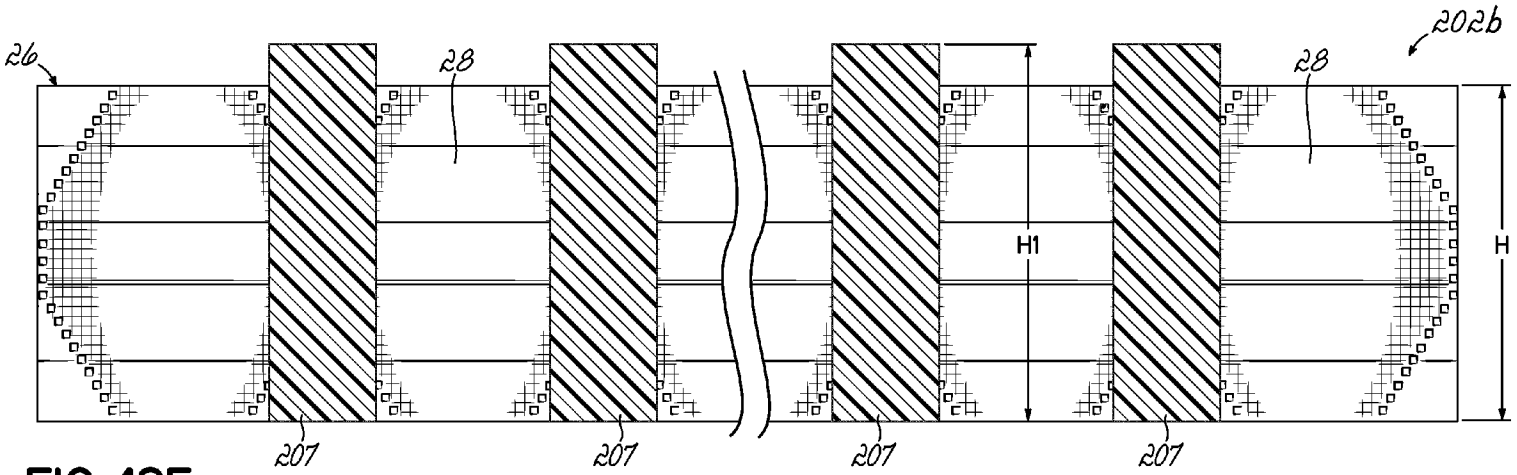
FIG. 12E is a cross-sectional view, partially broken away, of a portion of the interior of the product of FIG. 12D.

FIGS. 12D and 12E illustrate a corner like the corner shown in FIG. 12A of the interior 202*b* of another embodiment of bedding product or mattress like the bedding product or mattress 200 shown in FIG. 11. In this embodiment of mattress, all of the inserts 207, including the perimeter inserts, are a height H1 greater than the height H of the pocketed springs 28 of the strings of springs 26. See FIG. 2. As shown in FIGS. 12D and 13D, the interior inserts 207 are of the same height H1 as the height H1 of the perimeter inserts. If desired, as explained above, the perimeter inserts may be made of a different material to increase the firmness of the perimeter inserts 207 compared to the interior inserts 207 to provide edge support or edge firmness. Although not shown, the perimeter inserts may be taller than the pocketed springs 28 of the strings of springs 26 while the interior inserts may be the same height or shorter than the height H of the pocketed springs 28 of the strings of springs 26 to increase the firmness of the perimeter inserts compared to the interior inserts to provide edge support or edge firmness.

Figure 12F:
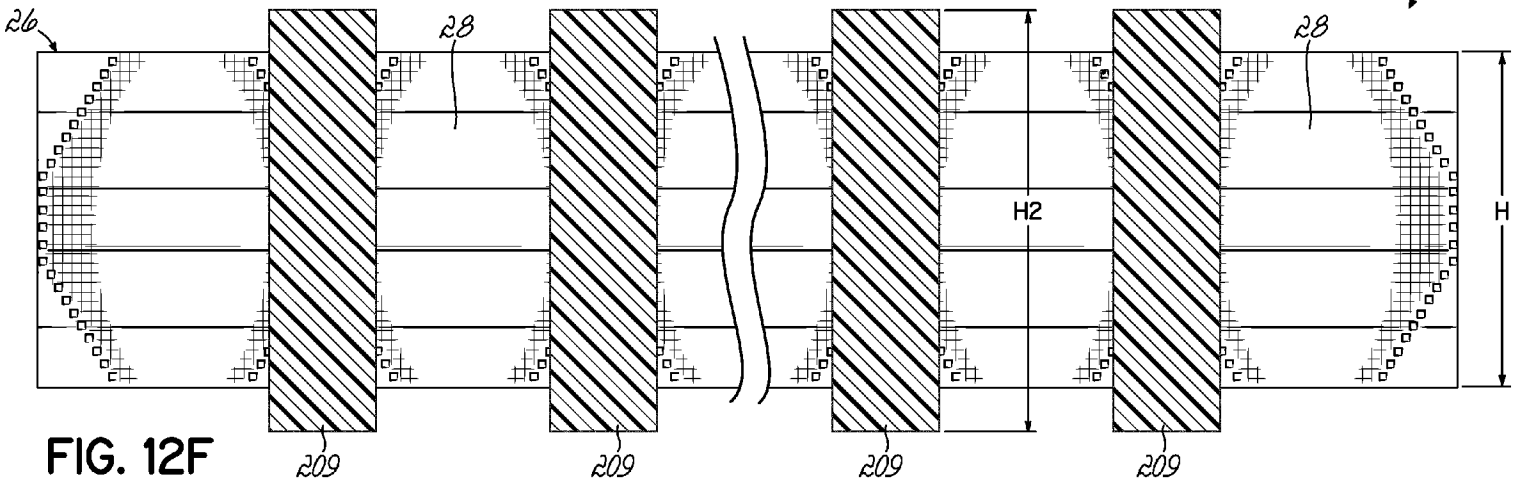
FIG. 12F is a cross-sectional view, partially broken away, of a portion of an alternative interior of a bedding or seating product.

FIG. 12F illustrates a cross-sectional view of the interior 202*c* of another embodiment of bedding product or mattress.

In this embodiment of mattress, all of the inserts 209, including the perimeter inserts, are a height H2 greater than the height H of the pocketed springs 28 of the strings of springs 26. See FIG. 2. As shown in FIG. 12F, the interior inserts 209 are of the same height as the height H2 of the perimeter inserts. If desired, as explained above, the perimeter inserts may be made of a different material to increase the firmness of the perimeter inserts 209 compared to the interior inserts 209 to provide edge support or edge firmness. Although not shown, in any of the embodiments shown or described herein, the perimeter inserts may be taller than the interior inserts which may be the same height or shorter than the height H of the pocketed springs 28 of the strings of springs 26 to increase the firmness of the perimeter inserts compared to the interior inserts to provide edge support or edge firmness.

Figure 14:
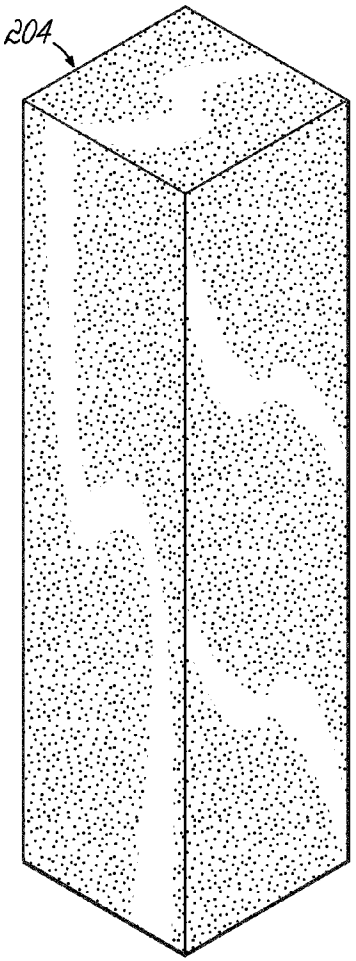
FIG. 14 is a perspective view of one of the foam inserts which may be used in any embodiment shown or described herein.

FIG. 14 illustrates one of the inserts 204 made of one piece of foam. As explained above, the foam may be latex foam, polyurethane foam or "viscoelastic" polyurethane memory foam or any other known foam. This cushion may be used at any desired location and mixed and matched with other inserts described herein to achieve the desired firmness or "feel" in a mattress or bedding or seating product.

Figure 15:
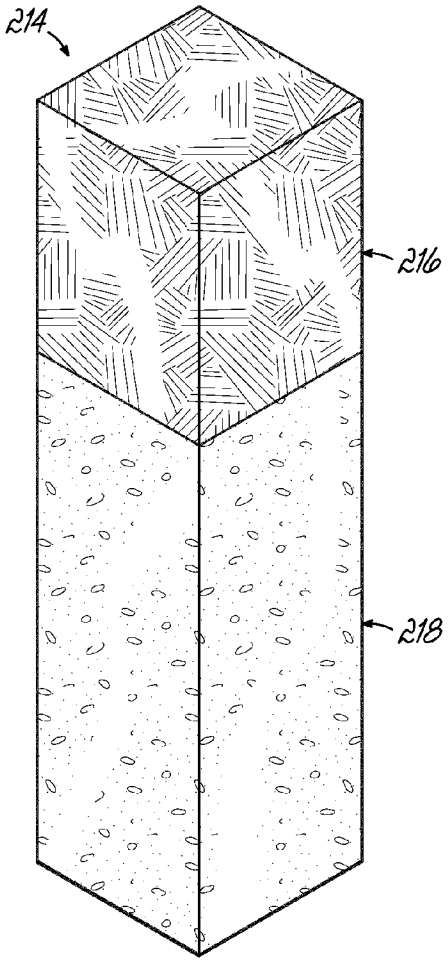
FIG. 15 is a perspective view of one of another foam cushion which may be used in any embodiment shown or described herein.

FIG. 15 illustrates another insert 214 made of two pieces of foam, piece 216 being on top of piece 218 and secured thereto. As explained above, either piece of foam may be latex foam, polyurethane foam or "viscoelastic" polyurethane memory foam or any other known foam. This insert may be used at any desired location and mixed and matched with other inserts described herein to achieve the desired firmness or "feel" in a mattress or bedding or seating product.

Figure 16:
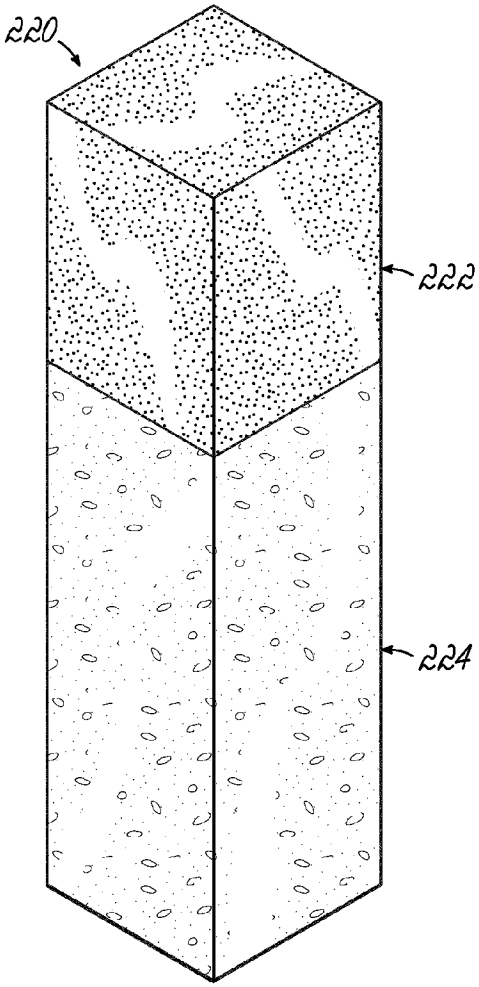
FIG. 16 is a perspective view of one of another foam cushion which may be used in any embodiment shown or described herein.

FIG. 16 illustrates another insert 220 made of one insert piece 222, such as a fiber batt, for example, being on top of one foam piece 224 and secured thereto. As explained above, the piece of foam 224 may be latex foam, polyurethane foam or "viscoelastic" polyurethane memory foam or any other known foam. This insert 220 may be used at any desired location and mixed and matched with other inserts described herein to achieve the desired firmness or "feel" in a mattress or bedding or seating product. Although not shown, in some cases, the piece of foam 224 may be above the other insert piece 222.

Figure 17:
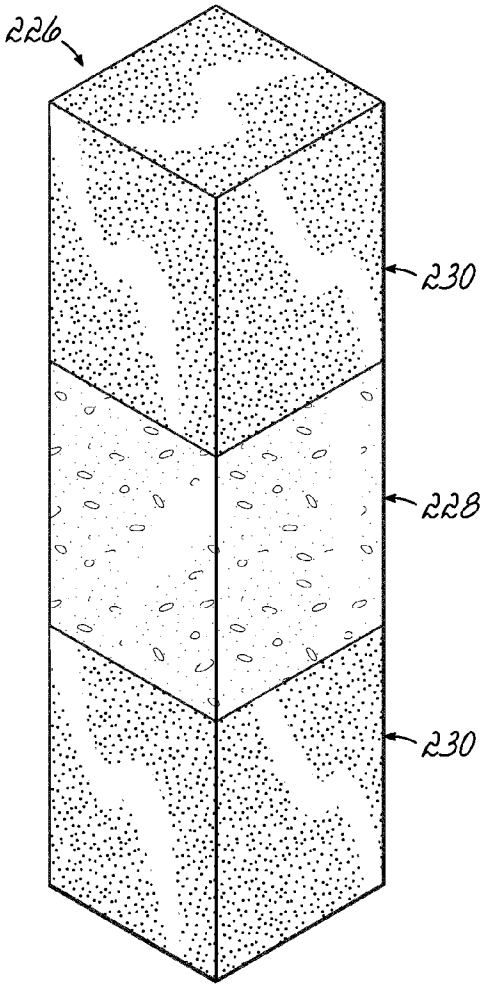
FIG. 17 is a perspective view of one of another foam cushion which may be used in any embodiment shown or described herein.

FIG. 17 illustrates another insert 226 made of three pieces of foam, a middle piece 228 being between end pieces 230 and secured thereto. As explained above, any of the pieces of foam may be latex foam, polyurethane foam or "viscoelastic" polyurethane memory foam or any other known foam. This insert may be used at any desired location and mixed and matched with other inserts described herein to achieve the desired firmness or "feel" in a mattress or bedding or seating product.

While we have described several preferred embodiments of this invention, persons skilled in this art will appreciate that other strings of springs may be utilized in the practice of this invention. Similarly, such persons will appreciate that each pocket may contain any number of coil springs or other type of spring, made of any desired material. Therefore, we do not intend to be limited except by the scope of the following appended claims.

We claim:

1. A posturized bedding or seating product comprising:

a pocketed spring assembly comprising a plurality of parallel strings of springs joined to each other, each of the strings of springs comprising a plurality of interconnected pockets, each of the pockets containing at least one spring encased in fabric, the fabric being joined to itself along a longitudinal seam;

wherein adjacent individually pocketed springs are separated from each other by a separating seam joining opposed first and second plies, each of the separating seams comprising first and second V-shaped end portions joined together by a linear portion, some of the strings of springs having a greater firmness than other strings of springs of the parallel strings of springs due, at least in part, to a difference in size of the V-shaped end portions, the pocketed spring assembly having different regions of different firmness, the separating seams of the strings of springs within each region being identical and different than the separating seams of the strings of springs of at least one other region;

cushioning materials on at least one side of the pocketed spring assembly; and an upholstered covering encasing the pocketed spring assembly and cushioning materials.

2. A posturized bedding or seating product comprising:

a pocketed spring assembly comprising a plurality of parallel strings of springs joined to each other, each of the strings of springs comprising a plurality of interconnected pockets, each of the pockets containing at least one spring encased in fabric, the fabric being joined to itself along a longitudinal seam;

wherein adjacent individually pocketed springs are separated from each other by a separating seam joining opposed first and second plies, each of the separating seams comprising first and second V-shaped end portions joined together by a linear portion, some of the strings of springs having a greater firmness than other strings of springs of the parallel strings of springs due, at least in part, to a difference in size of the V-shaped end portions, the pocketed spring assembly having different regions of different firmness, the separating seams of the strings of springs within each region being identical and different than the separating seams of the strings of springs of at least one other region.

3. The product of claim 2 wherein each of the springs has upper and lower end turns and a plurality of central convolutions between the end turns.

4. The product of claim 2 wherein at least some of the springs have a barrel shape.

5. The product of claim 2 wherein the strings of springs extend longitudinally.

6. The product of claim 2 wherein the strings of springs extend transversely.

7. The product of claim 2 wherein all of the springs have a barrel shape.

8. A posturized pocketed spring assembly for use in a bedding or seating product, the pocketed spring assembly comprising:

a plurality of strings of springs, each of said strings of springs comprising a piece of fabric joined to itself along a longitudinal seam and multiple spaced separating seams to define a plurality of pockets, each pocket containing at least one spring;

wherein opposed plies of the fabric being joined together by the separating seams, each of the separating seams comprising a linear portion and first and second branch portions, each branch portion comprising two diverging branches extending outwardly from one end of the linear portion of the separating seam;

the pocketed spring assembly having different regions of different firmness, the separating seam of the strings of springs within each region being identical and different than the separating seams of the strings of springs of at least one other region, the strings of springs of at least one region having a greater firmness than the strings of springs of at least one other region due, at least in part, to a difference in shape of the separating seams of the strings of springs.

9. The product of claim 8 wherein the strings of springs extend transversely.

10. The product of claim 8 wherein the strings of springs extend longitudinally.

11. The product of claim 10 wherein the longitudinal seam is below free edges of the fabric.

12. The product of claim 8 wherein each of the springs has upper and lower end turns and a plurality of central convolutions between the end turns.

13. The product of claim 8 wherein some of the separating seams comprises a pair of V-shaped end portions joined together by a linear portion.

14. A posturized pocketed spring assembly for use in a bedding or seating product, the pocketed spring assembly comprising:

a plurality of strings of springs, each of said strings of springs comprising a piece of fabric joined to itself along a longitudinal seam and multiple spaced separating seams to define a plurality of pockets, each pocket containing at least one spring, each spring having upper and lower end turns and central convolutions between the end turns, wherein each of the separating seams comprises a linear portion and a pair of branch portions, each branch portion extending outwardly from the linear portion of the separating seam, said spring assembly being characterized, when a load is placed upon the spring assembly, by the ability of at least some of the central convolutions of the spring to move laterally in the pocket of fabric, some of the strings of springs having a greater firmness than other strings of springs of the parallel strings of springs due, at least in part, to a difference in shape of the branch portions of the separating seams.

15. The product of claim 14 wherein at least some of the springs have a barrel shape.

16. The product of claim 14 wherein all of the springs have a barrel shape.

17. The product of claim 16 wherein the strings of springs extend longitudinally.

18. The product of claim 14 wherein each of the branch portions is a V-shaped end portion.

19. The product of claim 14 wherein the strings of springs extend transversely.

20. A posturized pocketed spring assembly for use in a bedding or seating product, the pocketed spring assembly comprising:

a plurality of strings of springs, each of said strings of springs comprising a plurality of interconnected pocketed springs, each spring of which is contained within a pocket of fabric, each spring having upper and lower end turns and central convolutions between the end turns, adjacent individually pocketed springs being separated from each other by at least one separating seam joining first and second plies on opposed sides of the string of springs, each of the separating seams comprising two Y-shaped seams joined together, said pocketed spring assembly being characterized, when a load is placed upon the pocketed spring assembly, by the ability of some of the central convolutions of the spring to move laterally in the pocket of fabric within which the spring is contained and return to their original position upon removal of the load, some of the strings of springs having a greater firmness than other strings of springs of the parallel strings of springs due, at least in part, to a difference in shape of the separating seams.

21. The product of claim 20 wherein at least some of the springs have a barrel shape.

22. The product of claim 20 wherein all of the springs have a barrel shape.

23. The product of claim 20 wherein the strings of springs extend transversely.

24. The product of claim 20 wherein the strings of springs extend longitudinally.

25. The product of claim 20 wherein a longitudinal seam is below free edges of the fabric.

* * * * *